US009367021B2

(12) United States Patent
Ishizuka et al.

(10) Patent No.: US 9,367,021 B2
(45) Date of Patent: Jun. 14, 2016

(54) IMAGE FORMING APPARATUS

(71) Applicants: Yusuke Ishizuka, Kanagawa (JP); Takeshi Shintani, Kanagawa (JP); Nobuo Kuwabara, Kanagawa (JP); Kenji Honjoh, Kanagawa (JP); Yasuhito Kuboshima, Tokyo (JP)

(72) Inventors: Yusuke Ishizuka, Kanagawa (JP); Takeshi Shintani, Kanagawa (JP); Nobuo Kuwabara, Kanagawa (JP); Kenji Honjoh, Kanagawa (JP); Yasuhito Kuboshima, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/605,355

(22) Filed: Jan. 26, 2015

(65) Prior Publication Data

US 2015/0227107 A1 Aug. 13, 2015

(30) Foreign Application Priority Data

Feb. 7, 2014 (JP) ..... 2014-022635
Apr. 16, 2014 (JP) ..... 2014-084292
Jun. 27, 2014 (JP) ..... 2014-132987

(51) Int. Cl.
*G03G 21/10* (2006.01)
*G03G 15/01* (2006.01)

(52) U.S. Cl.
CPC ..... *G03G 21/105* (2013.01); *G03G 15/0178* (2013.01); *G03G 15/0194* (2013.01)

(58) Field of Classification Search
CPC ... G03G 15/0178; G03G 15/01; G03G 21/10; G03G 2215/01
USPC ..... 399/98, 99
See application file for complete search history.

(56) References Cited

U.S. PATENT DOCUMENTS 5,689,782 A * 11/1997 Murakami ..... G03G 15/0808 399/272
7,366,458 B2 * 4/2008 Ishikawa ..... G03G 21/105 399/120
2009/0074470 A1 * 3/2009 Kouzu ..... G03G 21/105 399/257
2012/0163837 A1 6/2012 Tomita et al.
2012/0195664 A1 8/2012 Kuwabara et al.
2012/0315053 A1 12/2012 Kudo et al.
2012/0321330 A1 12/2012 Kudo et al.

FOREIGN PATENT DOCUMENTS

JP 08190242 A * 7/1996
JP 2002-236392 8/2002
JP 2009-015229 1/2009

* cited by examiner

*Primary Examiner* — Christopher Mahoney
(74) *Attorney, Agent, or Firm* — Harness, Dickey & Pierce, P.L.C.

(57) ABSTRACT

An image forming apparatus includes a controller and multiple image forming units each of which includes an image bearer, a toner image forming device to form a toner image on the image bearer, a transfer device to transfer the toner image from the image bearer onto a transfer medium, a cleaning device to remove toner from a surface of the image bearer, a waste-toner tube through which toner removed by the cleaning device is transported, and a toner conveying member to transport toner by rotation and disposed inside the waste-toner tube. The controller changes a rotation speed of the toner conveying member for each of the multiple image forming units according to toner type including a first toner and a second toner having poorer flow properties than the first toner, and at least one image forming units uses the second toner and the rest use the first toner.

20 Claims, 17 Drawing Sheets

IMAGE FORMING APPARATUS

CROSS-REFERENCE TO RELATED APPLICATIONS

This patent application is based on and claims priority pursuant to 35 U.S.C. §119(a) to Japanese Patent Application Nos. 2014-022635 filed on Feb. 7, 2014, 2014-084292 filed on Apr. 16, 2014, and 2014-132987 filed on Jun. 27, 2014, in the Japan Patent Office, the entire disclosure of each of which is hereby incorporated by reference herein.

BACKGROUND

1. Technical Field

Embodiments of the present invention generally relate to an image forming apparatus, such as a copier, a printer, a facsimile machine, and a multifunction peripheral (MFP) having at least two of copying, printing, facsimile transmission, plotting, and scanning capabilities.

2. Description of the Related Art

There are image forming apparatuses that superimpose multiple toner images of chromatic colors, such as yellow, magenta, cyan, and black images one on another on a sheet of recording media and fix the superimposed images using a fixing device, thereby obtaining a multicolor toner image. These chromatic color toners are hereinafter referred to as process color toners (i.e., yellow, cyan, magenta, and black).

Currently, image quality is diversified, and use of special toners other than process color toners, such as white toner and transparent toner, is proposed to attain value-added printing that is not attainable with process color toners.

When transparent toner having a high gloss level is superimposed on color images partly or entirely and fixed thereon, the gloss level of color images are enhanced.

In such image forming apparatuses, respective color toner images are formed on latent image bearers in respective image forming units. After the toner images are transferred from the latent image bearers onto a transfer medium such as recording paper or an intermediate transfer member, a cleaning device collects toner remaining thereon. The toner thus collected is transported, as waste toner, through a waste-toner channel and discharged from the cleaning device by a rotatable conveying screw. The waste toner is then collected in a waste-toner container inside the image forming apparatus and may be reused.

SUMMARY

An embodiment of the present invention provides an image forming apparatus that includes a controller and multiple image forming units. Each image forming unit includes an image bearer, a toner image forming device to form a toner image on the image bearer, a transfer device to transfer the toner image from the image bearer onto a transfer medium, a cleaning device to remove toner from a surface of the image bearer, a waste-toner tube through which toner removed by the cleaning device is transported, and a toner conveying member to transport toner by rotation and disposed inside the waste-toner tube. The controller changes a rotation speed of the toner conveying member for each of the multiple image forming units according to toner type including a first toner and a second toner having poorer flow properties than the first toner, and at least one image forming units uses the second toner and the remaining image forming units use the first toner.

Another embodiment provides an image forming apparatus that includes a controller and multiple image forming units. Each image forming unit includes the image bearer, the toner image forming device, the transfer device, the cleaning device, the waste-toner tube, and the toner conveying member described above. The cleaning device further includes a lubricant application roller to apply lubricant onto the surface of the image bearer and a driving source to drive both of the lubricant applicator and the toner conveying member. At least one of the multiple image forming units uses second toner having poorer flow properties than the first toner used in the remaining multiple image forming units. The controller sets a rotation speed of the driving source of the cleaning device of the image forming unit using the second toner to an increased rotation speed from a rotation speed of the driving source of the cleaning device of the image forming unit using the first toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
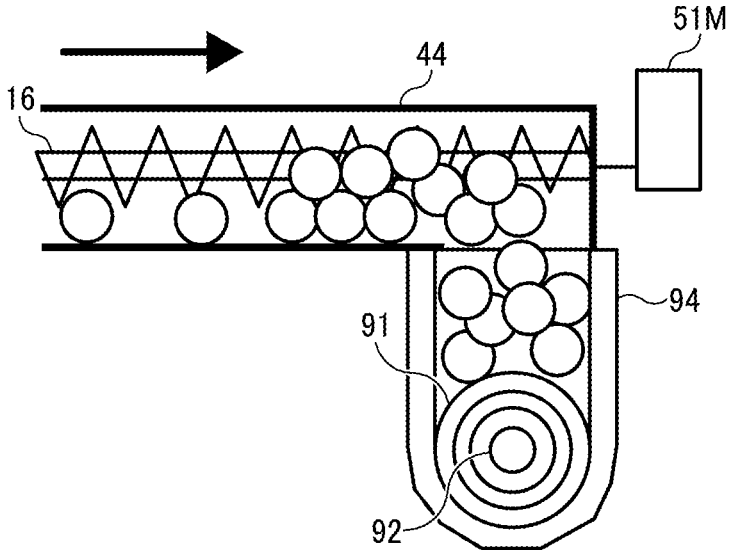
FIGS. 1A and 1B are schematic cross-sectional views illustrating transport of a first toner having better flow properties in a waste-toner conveyance route according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The types of toner used in image forming apparatuses include pulverized toner, which is produced by mechanical pulverization and irregular in shape, and polymerization toner, which is produced by polymerization and spherical in shape.

Compared with pulverized toner particles, polymerization toner particles are more uniform and spherical in shape. Reduction in particle diameter of polymerization toner is easier, and use of polymerization toner improves image quality. By contrast, irregular pulverized toner is more easily caught by a cleaning blade or the like of a cleaning device than polymerization toner, thus facilitating cleaning.

Therefore, use of polymerization toner for process color toners is advantageous in enhancing image quality, and use of pulverized toner for transparent toner, which less affects image quality, is advantageous in improving cleaning performance.

Polymerization toner and pulverized toner have different flow properties, that is, ease of transport by a conveying member such as a screw, auger, coil, or a paddle.

It is to be noted that, in this specification, the term "flow properties of toner" means ease of transport of toner by a toner conveying member, and differences in flow properties are represented by differences in the weight of toner transported per unit time under similar conditions (i.e., screw rotation speed and the like). When toner particles are circular in shape and smaller in diameter, flow properties of toner are better. Toner including an additive, such as silica, has better flow properties than toner base particles without additives.

In general, polymerization toner has better flow properties and pulverized toner has poorer flow properties. Therefore, the following inconveniences arise when a common structure is used, for example, for cost reduction, in the image forming unit using polymerization toner and that using pulverized toner.

In the image forming unit using pulverized toner, which has poorer flow properties, the amount per unit time of toner discharged from the cleaning device through a waste-toner channel by a conveying screw is smaller, and the possibility of clogging of the waste-toner channel increases. In particular, when pulverized toner is used as transparent toner, which is typically used in a larger image area ratio than that of process color toner, the possibility of clogging is high.

By contrast, in the image forming unit using polymerization toner, which has better flow properties, the amount per unit time of toner discharged from the cleaning device through the waste-toner channel by the conveying screw is greater, and it is possible that the transport capability of the conveying screw is excessive. As a result, the conveying screw receives an excessive load, and an operational life thereof is reduced.

It is to be noted that special toners are not limited to transparent toner. For example, white toner may be used. White toner is typically used to coat colored paper or transparent film entirely. Accordingly, the possibility of image failure such as line-like stains is lower compared with process color toners, which are used in various image densities.

Therefore, white toner does not require high image quality required for process color toners, and use of pulverized toner is advantageous in improving cleaning performance. Similar inconveniences arise when polymerization toner is used for process color toner and pulverized toner is used for white toner.

Although it is stated above that pulverized toner having poorer flow properties is used for special toner, such as transparent toner and white toner, which requires image quality lower than that of process color toner, it is possible that toner whose flow properties are better than that of process color toner is used. In such cases, similar inconveniences occur.

Referring now to the drawings, wherein like reference numerals designate identical or corresponding parts throughout the several views thereof, and particularly to FIG. 1, a multicolor image forming apparatus according to an embodiment of the present invention is described.

First Embodiment

Figure 2:
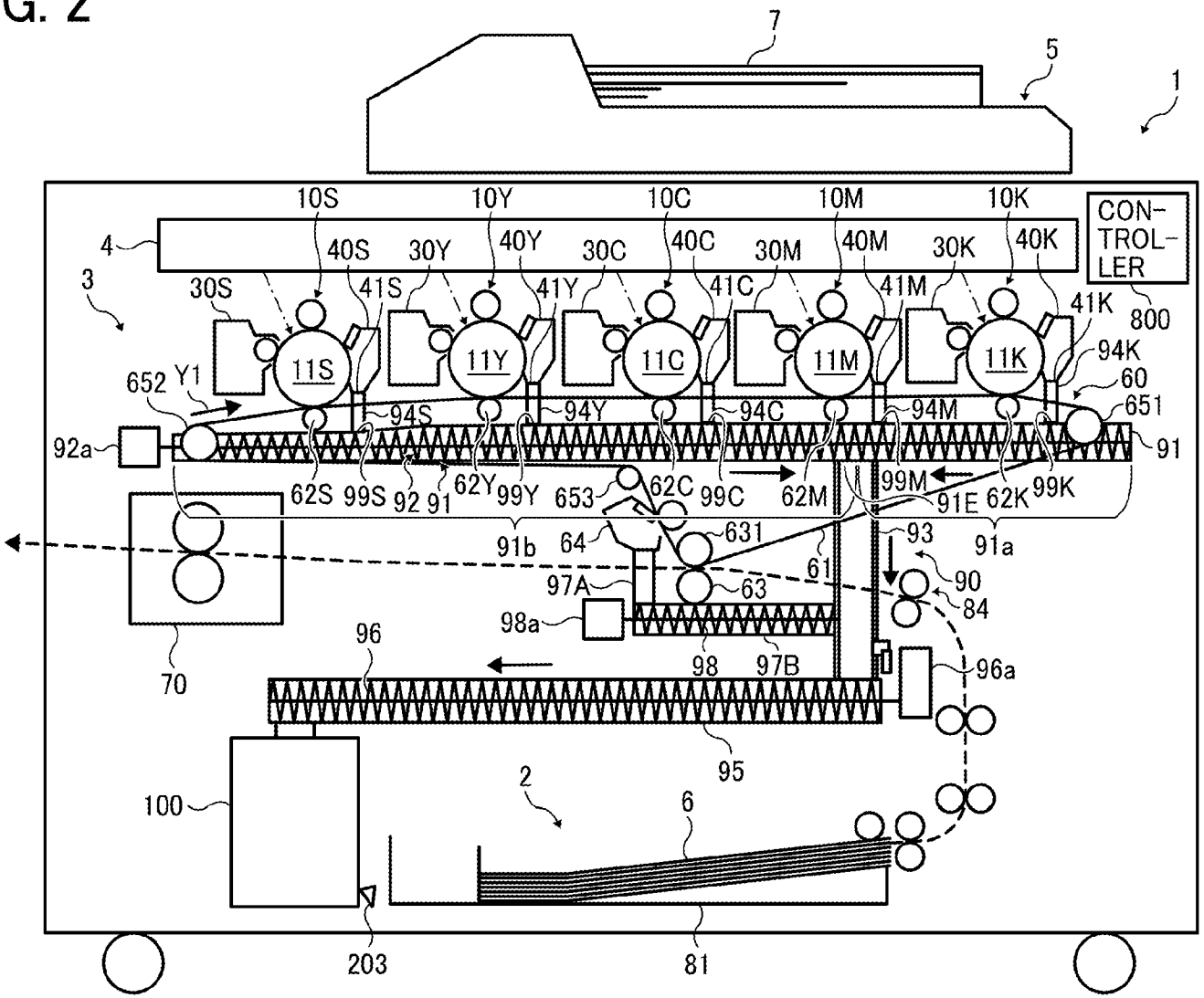
FIG. 2 is a schematic view of an entire image forming apparatus according to an embodiment.

FIG. 2 is a schematic entire view of an image forming apparatus according to the present embodiment.

An image forming apparatus 1 shown in FIG. 2 includes image forming units 10 (10Y, 10C, 10M, 10K, and 10S) arranged in parallel, usable as process cartridges removably installed in the image forming apparatus 1. In the image forming apparatus 1, different color images are superimposed one on another on an intermediate transfer belt 61 serving as a transfer medium, and the superimposed images are transferred onto a recording sheet 6 serving as a recording medium at a time.

The image forming apparatus 1 includes a controller 800 (such as a processor), which in one embodiment includes a computer including a central processing unit (CPU) and associated memory units (e.g., ROM, RAM, etc.). The computer performs various types of control processing by executing programs stored in the memory. Field programmable gate arrays (FPGA) may be used instead of CPUs.

As shown in FIG. 2, the image forming apparatus 1 includes an automatic document feeder (ADF) 5 to automatically transport an document 7 (e.g., an original document), a scanner 4 (i.e., a reading device) to read image data of the document 7, an image forming engine 3 to form toner images, and a sheet feeding unit 2 to contain and feed the recording sheet 6 to the image forming engine 3.

The image forming engine 3 includes the image forming units 10Y, 10C, 10M, and 10K respectively corresponding to colored toner, namely, yellow (Y), cyan (C), magenta (M), and black (K) toners, and further includes the image forming unit 10S corresponding to transparent toner (S), which may be called "clear toner". The image forming units 10Y, 10C, 10M, 10K, and 10S are arranged substantially horizontally, and thus the image forming apparatus 1 has a tandem structure. The image forming units 10Y, 10C, 10M, 10K, and 10S are similar in structure except the color of toner used therein.

It is to be noted that the suffixes S, Y, M, C, and K attached to each reference numeral indicate only that components indicated thereby are used for forming yellow, magenta, cyan, and black images, respectively, and hereinafter may be omitted when color discrimination is not necessary.

When toner images of yellow, cyan, magenta, and black are covered with transparent toner, the transparent toner serves as an overcoat to protect the toner images. Additionally, a pattern of transparent toner on a smooth sheet gives a texture like special paper or fancy paper.

It is to be noted that the order of image formation using transparent toner and colored toner is not limited to the description above.

In another embodiment, white toner is used instead of transparent toner. For example, when white toner is used instead of transparent toner, a color image is formed on a transparent sheet of recording media, using at least one of process color toners (e.g., yellow, cyan, magenta, and black toners). Then, a white toner image is formed on the color toner image. With the white color image, when the color toner image is viewed from a backside of the transparent sheet opposite an image side on which the color toner image is formed, the color toner image is not shown through the transparent sheet. Additionally, the transparent recording medium increases the gloss level, thus producing printing with uniform gloss level and added values.

An exposure device 4 disposed above the image forming units 10S, 10Y, 10C, 10M, and 10K exposes surfaces of photoconductors 11S, 11Y, 11C, 11M, and 11K with exposure light such as laser beams according to respective color image data, thereby forming latent images thereon. Thus, the exposure device 4 serves as a latent image forming device.

A transfer device 60 disposed beneath the image forming units 10 includes the endless intermediate transfer belt 61 that rotates in a state looped around a driving roller 651, a tension roller 652, an outer roller 653, and the like.

It is to be noted that reference numeral 203 represents a temperature and humidity sensor that serves as a humidity detector.

Figure 3:
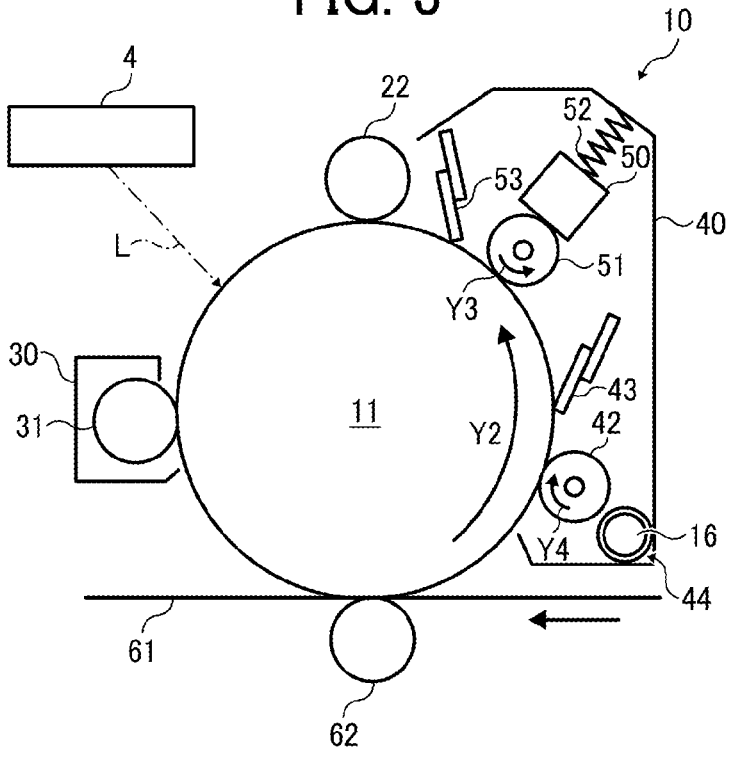
FIG. 3 is a schematic end-on axial view of an image forming unit according to an embodiment.

FIG. 3 is a schematic end-on axial view of the image forming unit 10.

The image forming unit 10 includes the photoconductor 11 serving as an image bearer, a charging roller 22 serving as a charging device to charge the surface of the photoconductor 11, and a developing device 30. The charged surface of the photoconductor 11 is irradiated with laser light L by the exposure device 4, and the developing device 30 supplies toner to the latent image on the photoconductor 11, thus developing the latent image into a toner image. The charging roller 22 and the developing device 30 serve as a toner image forming device.

Each image forming unit 10 further includes a cleaning device 40 to remove toner remaining on the photoconductor 11 after the toner image developed by the developing devices 30 is transferred by a primary-transfer roller 62 onto the intermediate transfer belt 61.

The charging roller 22 is electrically connected to a power source that applies a predetermined or a desirable charging bias to the charging roller 22. The charging roller 22 is disposed across a minute gap from the photoconductor 11. In another embodiment, the charging roller 22 is disposed in contact with the photoconductor 11.

The developing device 30 employs two-component developer including magnetic carrier and toner (hereinafter simply "developer"). The developing device 30 is disposed facing the photoconductor 11 to develop the latent image thereon.

The developing device 30 includes a developing roller 31 serving as a developer bearer. The developing roller 31 transports developer to a position facing the photoconductor 11 after a developer regulator adjusts the thickness of a layer of developer on the developing roller 31.

The cleaning device 40 includes a discharge lamp to discharge the photoconductor 11 before cleaned, a cleaning brush roller 42 (a rotatable brush), a cleaning blade 43, an application roller 51, and a leveling blade 53, which are disposed in that order in the direction of rotation of the photoconductor 11 indicated by arrow Y2 in FIG. 3.

In the cleaning device 40, the cleaning brush roller 42 and the cleaning blade 43 together serve as a toner remover. The application roller 51 and a solid lubricant 50 held by a bracket and pressed by a pressure spring 52 to the application roller 51 together serve as a lubricating mechanism.

After the toner image is transferred therefrom at a primary-transfer position, where the photoconductor 11 faces the primary-transfer roller 62, the surface of the photoconductor 11 is discharged by the discharge lamp. Then, the cleaning brush roller 42 scrapes toner remaining thereon (i.e., untransferred toner), which facilitates removal of toner by the cleaning blade 43 situated downstream from the cleaning brush roller 42 in the direction of rotation of the photoconductor 11.

The cleaning device 40 further includes a flicker to flick off toner from the cleaning brush roller 42 and a toner outlet 41. The toner is transported through a waste-toner conveying pipe 44, in which a conveying screw 16 is disposed, and discharged as waste toner from the cleaning device 40. The waste toner discharged from the cleaning device 40 is transported by a waste-toner conveyance device 90 to a waste-toner container 100 and stored therein. The waste-toner conveying pipe 44 (i.e., a waste-toner tube) that is a hollow member through which toner removed by the cleaning device 40 is transported.

Figure 1B:
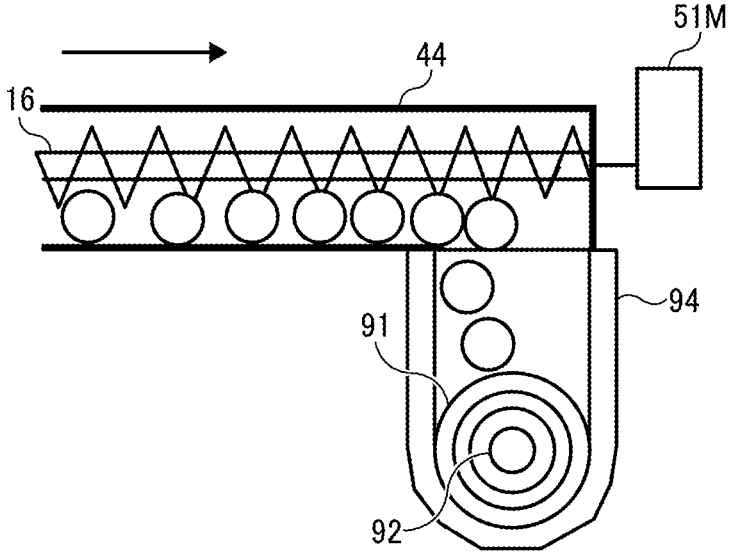

In the configuration shown in FIG. 3, the application roller 51 and the conveying screw 16 are driven by a driving motor 51M, shown in FIGS. 1A and 1B, as a common driving source. However, in another embodiment, the application roller 51 and the conveying screw 16 are driven by separate driving sources.

The cleaning brush roller 42 rotates in the direction indicated by arrow Y4, which follows the direction of rotation of the photoconductor 11. That is, at the position where the cleaning brush roller 42 faces the photoconductor 11, the cleaning brush roller 42 and the photoconductor 11 rotate in an identical direction. The cleaning blade 43 is secured to a rotatable holder and held to contact the surface of the photoconductor 11 in a direction counter to the direction of rotation of the photoconductor 11.

Additionally, the cleaning blade 43 is pressed by a pressure spring against the photoconductor 11 to remove toner from the photoconductor 11.

After toner is removed therefrom, the photoconductor 11 is lubricated by the application roller 51. In the present embodiment, zinc stearate, boron nitride, and alumina are mixed and compressed into the solid lubricant 50.

The application roller 51 scrapes away powdered lubricant from the solid lubricant 50, which is held by the bracket and pressed by the pressure spring 52 to the application roller 51, and the application roller 51 applies the powdered lubricant onto the surface of the photoconductor 11.

The application roller 51 rotates in the direction indicated by arrow Y3, which is opposite the direction of rotation of the photoconductor 11 at the position where the application roller 51 faces the photoconductor 11. The leveling blade 53 is supported to contact the surface of the photoconductor 11 in the direction counter to the direction of rotation of the photoconductor 11. The leveling blade 53 levels off the powdered lubricant applied to the surface of the photoconductor 11 by the application roller 51.

Figure 4:
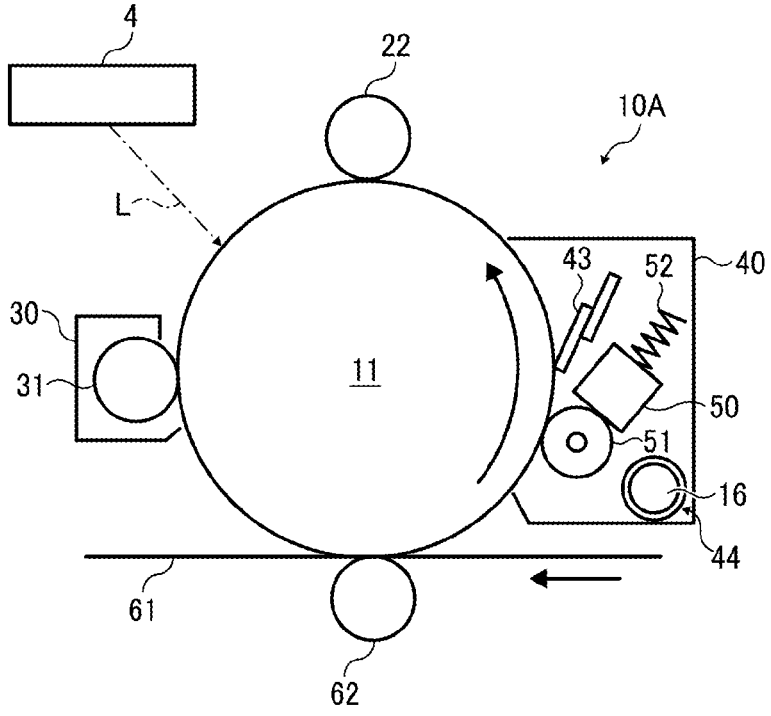
FIG. 4 is a schematic end-on axial view of an image forming unit according to another embodiment.

It is to be noted that, as shown in FIG. 4, an image forming unit 10A according to another embodiment does not include the cleaning brush roller 42 and the leveling blade 53, and the cleaning blade 43 is disposed downstream from the application roller 51 in the direction of rotation of the photoconductor 11. In this configuration, the cleaning blade 43 doubles as a leveling blade to level off the lubricant applied onto the photoconductor 11 by the application roller 51.

The transfer device 60 includes the endless intermediate transfer belt 61 that rotates, looped around the driving roller 651, the tension roller 652, and the outer roller 653. The transfer device 60 further includes the primary-transfer rollers 62 to primarily transfer the toner images from the respective photoconductors 11 onto the intermediate transfer belt 61 and a secondary-transfer roller 63 to transfer the toner image from the intermediate transfer belt 61 onto the recording sheet 6.

The primary-transfer rollers 62 are disposed facing the respective photoconductors 11 across the intermediate transfer belt 61. Each primary-transfer roller 62 is electrically connected to a power source and receives a predetermined primary-transfer bias.

The secondary-transfer roller 63 secondarily transfers the toner image from the intermediate transfer belt 61 onto the recording sheet 6 (i.e., a secondary-transfer process). The secondary-transfer roller 63 is opposed to a roller 631 and electrically connected to a power source and receives a predetermined secondary-transfer bias similar to the primary-transfer rollers 62.

Additionally, a belt cleaning device 64 is provided to clean the surface of the intermediate transfer belt 61 after the secondary-transfer process. The image forming apparatus 1 further includes a lubrication device to lubricate the intermediate transfer belt 61.

The image forming apparatus 1 according the present embodiment further includes a contact/separation mechanism to position the photoconductors 11 adjacent to and away from the intermediate transfer belt 61. The contact/separation mechanism in the present embodiment moves away, from the corresponding photoconductor 11, the primary-transfer roller 62 that supports the intermediate transfer belt 61 from an inner circumferential side.

On the left of the transfer device 60 in FIG. 2, a fixing device 70 to fix the toner image on the recording sheet 6 is provided. The fixing device 70 includes a fixing roller inside which a halogen heater is provided and a pressure roller to press against the fixing roller.

Image forming operation of the image forming apparatus 1 in the present embodiment is described below.

According to the image formation type, the contact/separation mechanism positions the photoconductor 11 of each image forming unit 10 used in image formation adjacent to the intermediate transfer belt 61 and moves that of the image forming unit 10 not used away from the intermediate transfer belt 61.

The photoconductor 11 in contact with the intermediate transfer belt 61 rotates counterclockwise in the drawing, driven by a driving unit. The charging roller 22 uniformly charges, to a predetermined polarity, the surface of the photoconductor 11 that rotates. The exposure device 4 directs the laser beam to the surface of the photoconductor 11 thus charged to form an electrostatic latent image thereon. The developing devices 30 supply the corresponding color toners to the electrostatic latent image, thereby developing it into a toner image.

As the photoconductors 11 rotate, the intermediate transfer belt 61 rotate clockwise in FIG. 2 as indicated by arrow Y1. With actions of the primary-transfer rollers 62, the respective color toner images are primarily transferred from the photoconductors 11 and superimposed one on another on the intermediate transfer belt 61.

After the toner image is transferred therefrom, toner remaining on the surface of the photoconductor 11 is collected by the cleaning device 40 and transported to the waste-toner container 100 by the waste-toner conveyance device 90 described later.

Meanwhile, the recording sheet 6 is fed from a sheet feeding tray 81 and forwarded by registration rollers 84 to a secondary-transfer position, timed to coincide with the toner image on the intermediate transfer belt 61. With actions of the secondary-transfer roller 63, the toner image is secondarily transferred from the intermediate transfer belt 61 onto the recording sheet 6.

Although the configuration shown in FIG. 2 employs intermediate image transfer, alternatively, direct image transfer may be employed. In that case, the toner image is transferred from the photoconductor 11 onto the recording sheet 6 serving as a transfer medium.

After the secondary-transfer process, the recording sheet 6 is transported to the fixing device 70. While the recording sheet 6 passes through the fixing device 70, the toner image is fixed thereon with heat and pressure. After the toner image is fixed thereon, the recording sheet 6 is discharged to a paper ejection tray.

The image forming apparatus 1 according to the present embodiment is capable of four different operations (modes) of full-color image formation, monochrome image formation, special image formation, and a combined formation of full-color image and special image.

Full-color image formation is to form full-color images using yellow, magenta, cyan, and magenta toners.

In full-color image formation, the contact/separation mechanism positions the primary-transfer rollers 62Y, 62C, and 62M adjacent to the photoconductors 11Y, 11C, and 11M so that the intermediate transfer belt 61 contacts the photoconductors 11Y, 11C, and 11M.

By contrast, the image forming units 105 and 10K are not used in full-color image formation according to the present embodiment, and the contact/separation mechanism positions the primary-transfer rollers 62S and 62K away from the photoconductors 115 and 11K.

Then, the intermediate transfer belt 61 is stretched flat in a portion between the tension roller 652 and the primary-transfer roller 62Y respectively downstream and upstream from the primary-transfer roller 62S in the direction indicated by arrow Y1 in FIG. 2, in which the intermediate transfer belt 61 rotates (hereinafter "belt conveyance direction Y1"), and the intermediate transfer belt 61 is disengaged from the photoconductor 11S.

The intermediate transfer belt 61 becomes flat similarly in a portion stretched between the primary-transfer roller 62M and the driving roller 651 respectively downstream and upstream from the primary-transfer roller 62K in the belt conveyance direction Y1, and the intermediate transfer belt 61 is disengaged from the photoconductor 11K.

It is to be noted that, in full-color image formation according to another embodiment, black toner is used in addition to yellow, cyan, and magenta toners. In this case, the contact/separation mechanism positions the primary-transfer rollers 62Y, 62C, 62M, and 62K adjacent to the photoconductors 11Y, 11C, 11M, and 11K so that the intermediate transfer belt 61 contacts the photoconductors 11Y, 11C, 11M, and 11K.

By contrast, the image forming unit 10S is not used in full-color image formation, and the contact/separation mechanism positions the primary-transfer roller 62S away from the photoconductor 11S, thereby disengaging the intermediate transfer belt 61 from the photoconductor 11S.

Monochrome image formation is to form images using black toner. In monochrome image formation, the primary-transfer roller 62K is positioned adjacent to the photoconductor 11K so that the intermediate transfer belt 61 contacts the photoconductor 11K.

By contrast, the image forming units 10S, 10Y, 10C, and 10M are not used in monochrome image formation, and the contact/separation mechanism positions the primary-transfer rollers 62S, 62Y, 62C, and 62M away from the corresponding photoconductors 11.

Then, the intermediate transfer belt 61 is stretched flat in a portion between the tension roller 652, downstream from the primary-transfer roller 62S in the direction indicated by arrow Y1 in FIG. 2, and the primary-transfer roller 62K, and the intermediate transfer belt 61 is disengaged from the photoconductors 11S, 11Y, 11C, and 11M.

Special image formation is to form images using special toner. In special image formation, the primary-transfer roller 62S is positioned adjacent to the photoconductor 11S so that the intermediate transfer belt 61 contacts the photoconductor 11S.

By contrast, the image forming units 10Y, 10C, 10M, and 10K are not used in special image formation, and the primary-transfer rollers 62Y, 62C, 62M, and 62K are positioned away from the corresponding photoconductors 11.

Then, the intermediate transfer belt 61 is stretched flat in a portion between the primary-transfer roller 62S and the driving roller 651 upstream from the primary-transfer roller 62K in the direction indicated by arrow Y1 in FIG. 2, and the intermediate transfer belt 61 is disengaged from the photoconductors 11Y, 11C, 11M, and 11K.

Combined formation of full-color image and special image is to form images using all of the image forming units 10S, 10Y, 10C, 10M, and 10K. In combined formation of full-color image and special image, the contact/separation mechanism positions the primary-transfer rollers 62S, 62Y, 62C, 62M, and 62K adjacent to the photoconductors 11S, 11Y, 11C, 11M, and 11K so that the intermediate transfer belt 61 contacts the photoconductors 11S, 11Y, 11C, 11M, and 11K.

Next, transport of waste toner is described below.

In the present embodiment, waste toner, such as untransferred toner collected by the cleaning device 40, is discharged through the toner outlet 41 of the cleaning device 40.

Then, the waste-toner conveyance device 90 transports the waste toner to a waste-toner container 100.

The waste-toner conveyance device 90 includes a common conveying pipe 91 common to the respective toners. The common conveying pipe 91 is linear and extends substantially horizontally, adjacent to the respective cleaning devices 40. The waste-toner container 100 collects waste toner discharged from the respective cleaning devices 40 to the common conveying pipe 91 via communicating pipes 94 connecting the common conveying pipe 91 with the toner outlets 41 (waste-toner conveying pipe 44) of the respective cleaning devices 40. Each of the communicating pipes 94 serves as a downstream conveyance tube.

The common conveying pipe 91 serves as a downstream conveyance tube to define a common conveyance channel through which toner is transported. The tubular member may be a tube or the like. A conveying screw 92 provided inside the conveying pipe serves as a rotatable developer conveyor to transport waste toner in a direction of rotation axis thereof (hereinafter "axial direction").

As a driving motor 92*a* rotates the conveying screw 92, the waste toner inside the common conveying pipe 91 is transported linearly in the axial direction thereof inside the common conveying pipe 91.

The conveying screw 92 includes a rotation shaft and a screw blade provided on the rotation shaft. An outer end of the screw blade is positioned across a small gap from an inner face of the common conveying pipe 91 (i.e., an inner wall of the conveying pipe).

An exit 91E of the common conveying pipe 91 is in a bottom of the common conveying pipe 91 and positioned between a portion connected to the communicating pipe 94M for magenta toner and a portion connected to the communicating pipe 94C for cyan toner.

The conveying screw 92 in the common conveying pipe 91 includes screw blade portions different in winding directions so that the waste toner inside the common conveying pipe 91 is transported in the opposite directions to the exit 91E from both sides.

Specifically, in FIG. 3, the screw blade portion on the left of the exit 91E spirals in a direction to transport waste toner from the left to the right, and the screw blade portion on the right of the exit 91E spirals in the opposite direction to transport waste toner from the right to the left.

With this configuration, by rotating the conveying screw 92 in a predetermined direction, the waste toner inside the common conveying pipe 91 is transported to the exit 91E positioned midway through the common conveying pipe 91. Then, waste toner falls from the exit 91E to a vertical conveyance channel 93.

A lower end of the vertical conveyance channel 93 communicates with an upper face of a first end (a right end in the drawing) of a horizontal conveyance channel 95, and the waste toner falls through the vertical conveyance channel 93 to the first end of the horizontal conveyance channel 95. As a driving motor 96*a* rotates the conveying screw 96, the waste toner inside the horizontal conveyance channel 95 is transported linearly in the axial direction thereof to a second end side (on the left in the drawing) of the horizontal conveyance channel 95.

The horizontal conveyance channel 95 is in a conveying pipe similar to the common conveying pipe 91, and a conveying screw 96 is provided therein.

An outlet is provided in a bottom of the second end side (on the left in the drawing) of the horizontal conveyance channel 95 to discharge waste toner from the horizontal conveyance channel 95 downward to the waste-toner container 100. On the second end side of the horizontal conveyance channel 95, waste toner falls through the outlet to the waste-toner container 100 and stored therein.

The waste-toner conveyance device 90 according to the present embodiment transports, to the waste-toner container 100, the waste toner collected from the intermediate transfer belt 61 by the belt cleaning device 64 as well.

Specifically, the waste toner discharged from the belt cleaning device 64 is transported from a communicating channel 97A to a second end side (on the left in the drawing) of a horizontal communicating channel 97B.

The horizontal communicating channel 97B is in a conveying pipe similar to the common conveying pipe 91, and a conveying screw 98 is provided therein. As a driving motor 98*a* rotates the conveying screw 98, the waste toner inside the horizontal communicating channel 97B is transported linearly in the axial direction thereof to a first end side (on the right in the drawing) of the horizontal communicating channel 97B.

A first end (on the right in the drawing) of the horizontal communicating channel 97B is connected to an intermediate portion of the vertical conveyance channel 93. On the first end side of the horizontal communicating channel 97B, waste toner is introduced into the vertical conveyance channel 93 and falls to the first end of the horizontal conveyance channel 95.

With this configuration, the waste toner discharged from the belt cleaning device 64 is transported inside the horizontal conveyance channel 95 to the waste-toner container 100 and stored therein, together with the waste toner discharged from the cleaning devices 40 of the respective image forming units 10.

Next, a distinctive feature of the present embodiment is described below.

In the image forming apparatus 1 according to the present embodiment, in addition to process color toners of yellow (Y), cyan (C), magenta (M), and black (K) toners, transparent toner (S) is used as special toner. It is possible that special toner is different from process color toners in flow properties.

It is to be noted that, in the present embodiment, process color toners are polymerization toners, and transparent toner is pulverized toner.

Figure 5A:
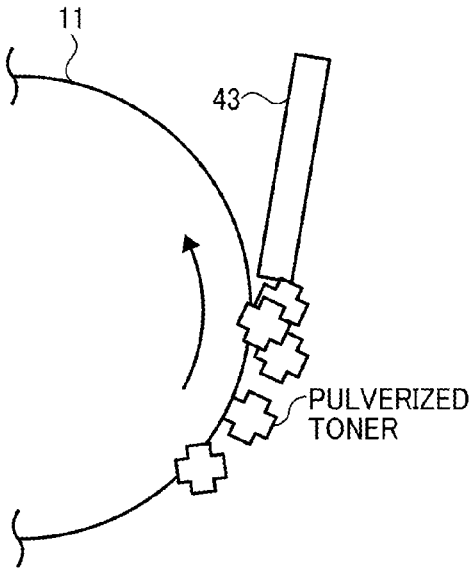
FIGS. 5A and 5B are schematic end-on axial views illustrating removal of pulverized toner and polymerization toner from a photoconductor according to an embodiment.
Figure 5B:
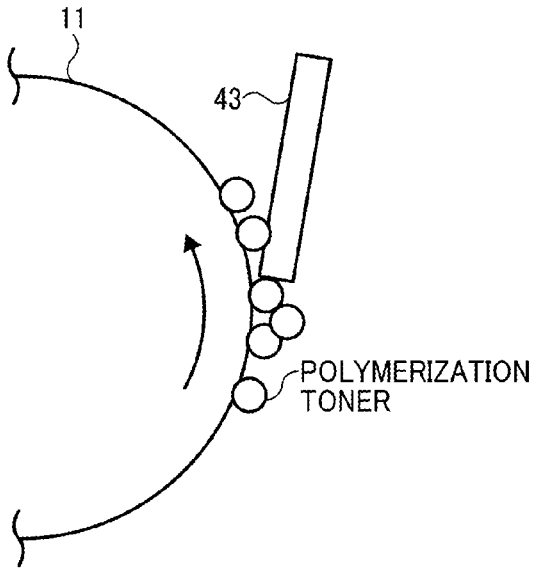

Referring to FIGS. 5A and 5B, descriptions are given below of differences in easiness in removal of pulverized toner and polymerization toner.

As shown in FIG. 5A, owing to its irregular shape, pulverized toner adhering to the surface of the photoconductor 11 is easily caught by the cleaning blade 43. Thus, removal of pulverized toner from the photoconductor 11 is relatively easy. By contrast, as shown in FIG. 5B, owing to a high degree of circularity, polymerization toner adhering to the surface of the photoconductor 11 easily escapes from the cleaning blade 43. Thus, removal of polymerization toner from the photoconductor 11 is relatively difficult.

Figure 6A:
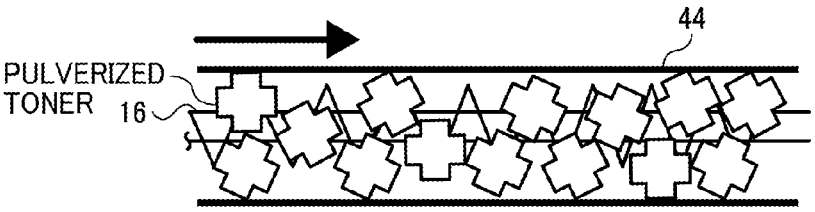
FIGS. 6A and 6B are schematic cross-sectional views illustrating transport of pulverized toner and polymerization toner in a waste-toner channel according to an embodiment.
Figure 6B:
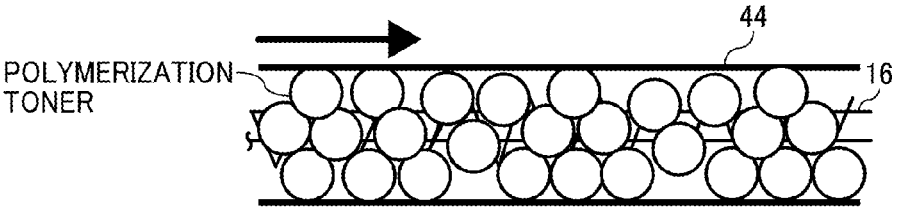

FIGS. 6A and 6B are schematic cross-sectional views of the waste-toner conveying pipe 44 for understanding of differences in flow properties between pulverized toner and polymerization toner.

Since the shape thereof is irregular, as shown in FIG. 6A, the density of pulverized toner inside the waste-toner conveying pipe 44 is smaller, and flow properties are lower. That is, the weight of pulverized toner transported per unit time is smaller. By contrast, since the degree of circularity is higher, as shown in FIG. 6B, the density of polymerization toner inside the waste-toner conveying pipe 44 is greater, and the weight of polymerization toner transported per unit time is greater.

FIGS. 1A and 1B are schematic cross-sectional views of the waste-toner conveying pipe 44 of the cleaning device 40 and the communicating pipe 94. FIG. 1A is for understanding of inconveniences that arise when the first toner having better flow properties, such as polymerization toner, is used.

When polymerization toner, the flow properties of which are better, is used, the amount per unit time of toner discharged (toner discharge amount per unit time) from the cleaning device 40 to the common conveying pipe 91 is greater. This increases the possibility that the communicating pipe 94, through which waste toner flows from the cleaning device 40 to the common conveying pipe 91, is clogged with toner.

In view of the foregoing, in the present embodiment, in the cleaning device 40 of the image forming unit 10 employing polymerization toner, the rotation speed of the conveying screw 16 is reduced. With this setting, as shown in FIG. 1B, compared with a case in which the conveying screw 16 is rotated at a higher speed, the toner discharge amount per unit time from the cleaning device 40 to the common conveying pipe 91 is reduced. Accordingly, clogging of the communicating pipe 94 with toner is inhibited. Additionally, with the decrease in rotation speed of the conveying screw 16, the load on the conveying screw 16 is reduced, thereby elongating the operational life of the conveying screw 16.

Figure 7A:
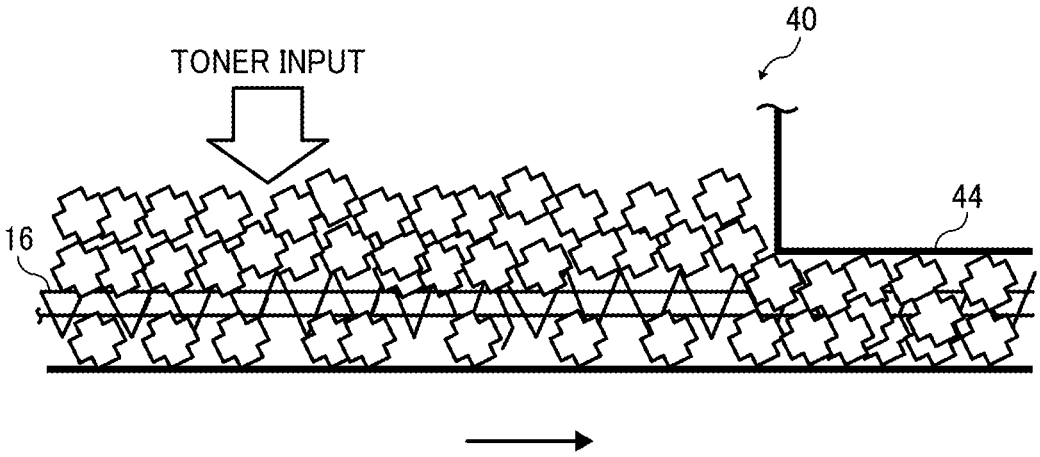
FIGS. 7A and 7B are schematic cross-sectional views of the waste-toner channel shown in FIGS. 6A and 6B, in a state in which a second toner having poorer flow properties is used.
Figure 7B:
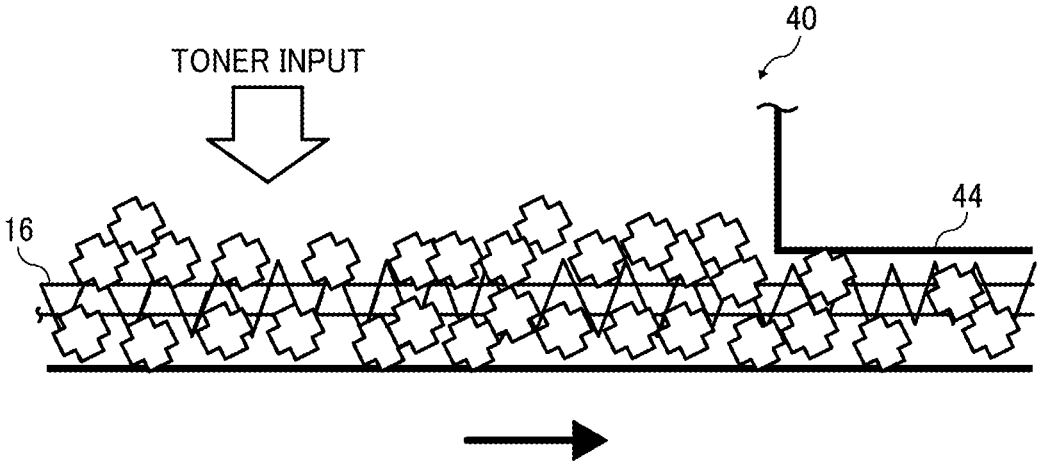

FIGS. 7A and 7B are schematic cross-sectional views of the waste-toner conveying pipe 44. FIG. 7A is a diagram illustrating inconveniences that arise when the second toner having poorer flow properties, such as pulverized toner, is used.

When pulverized toner is used, as shown in FIG. 7A, the toner discharge amount per unit time from the waste-toner conveying pipe 44 to the common conveying pipe 91 does not keep up with the amount of toner input from the cleaning device 40. Then, there arises the possibility of overflow of toner or clogging with toner of the waste-toner conveying pipe 44.

In view of the foregoing, in the present embodiment, in the cleaning device 40 of the image forming unit 10 employing pulverized toner, the rotation speed of the conveying screw 16 is increased.

With this setting, compared with a case in which the conveying screw 16 is rotated at a lower speed, the transport capability of the conveying screw 16 is enhanced, thereby facilitating discharge of toner from the waste-toner conveying pipe 44 to the common conveying pipe 91.

Accordingly, the toner discharge amount from the waste-toner conveying pipe 44 to the common conveying pipe 91 is increased relative to the amount of toner input from the cleaning device 40. Accordingly, as shown in FIG. 7B, the occurrence of overflow of toner or clogging with toner of the waste-toner conveying pipe 44 is suppressed.

In the present embodiment, the rotational speed of each of the conveying screws 16Y, 16C, 16M, and 16K of the image forming units 10Y, 10C, 10M, and 10K employing polymerization toner for process color toner is set at a reference speed.

While the conveying screws 16Y, 16C, 16M, and 16K are kept at the reference speed, the conveying screw 16S of the image forming unit 10 employing, as transparent toner, pulverized toner that is less easily transported, is set at a speed increased from the reference speed.

This setting improves the transport capability of the conveying screw 16S and facilitates discharge of pulverized toner from the waste-toner conveying pipe 44 to the common conveying pipe 91. Accordingly, the occurrence of overflow of toner or clogging with toner of the waste-toner conveying pipe 44 is suppressed. Although polymerization toner serves as the first toner having better flow properties and pulverized toner serves as the second toner having poorer flow properties in the present embodiment, the combination of first and second toners is not limited to the combination of polymerization toner and pulverized toner. Even if both toners are produced by a similar method (i.e., polymerization, pulverization, or the like), flow properties thereof differ depending on particle diameter, additives, and the like. For example, in one embodiment, the first toner is a polymerization toner having a smaller diameter, and the second toner is a polymerization toner having a larger diameter.

It is to be noted that, when white toner that is pulverized toner is used instead of transparent toner, the conveying screw 16S of the image forming unit 10S employing white toner is set at the speed increased from the reference speed. With this setting, the occurrence of overflow of toner or clogging with toner of the waste-toner conveying pipe 44 of the cleaning device 40S corresponding to white toner is suppressed.

It is to be noted that, if the rotation speed of the conveying screw 16 is increased constantly aiming at improving the capability of the conveying screw 16 to transport waste toner, it is possible that the operational life of the conveying screw 16 is shortened due to excessive rotation thereof.

Additionally, in the configuration shown in FIG. 3, in which the conveying screw 16 and the application roller 51 are driven by the driving motor 51M as a common driving source, the rotational speed of the application roller 51 increases as the rotation speed of the conveying screw 16 increases. Accordingly, it is possible that the life of the solid lubricant 50 is shortened, or the charging roller 22 is stained due to excessive lubrication of the photoconductor 11, thus shortening the operational life of the charging roller 22.

Therefore, in the present embodiment, the rotation speed of the conveying screw 16 is increased when the amount of toner removed from the photoconductor 11 by the cleaning device 40 is relatively large. Specifically, the rotation speed of the conveying screw 16 is increased when a toner-related variable, which relates to the amount of toner removed by the cleaning device 40, exceeds a predetermined threshold level. The toner-related variable includes image area ratio and setting of amount of toner adhering to the photoconductor 11 (i.e., toner adhesion amount) when a latent image is developed. In other words, the toner-related variables are criteria for judging whether to increase the rotational speed. For example, the image area ratio is calculated by the controller 800 according to image data input to the image forming apparatus 1.

This control alleviates decreases in operational life of the conveying screw 16 caused by excessive rotation thereof. Additionally, in the above-described configuration in which the conveying screw 16 and the application roller 51 are driven by the common driving source (driving motor 51M), this control inhibits the application roller 51 from excessively scraping off lubricant from the solid lubricant 50, thereby alleviating decreases in operational life of the solid lubricant 50, the charging roller 22, or both.

For example, regarding the toner adhesion amount to the photoconductor 11, a target toner adhesion amount (i.e., setting) is preset in software and retrieved in controlling the rotation speed of the conveying screw 16.

Figure 8A:
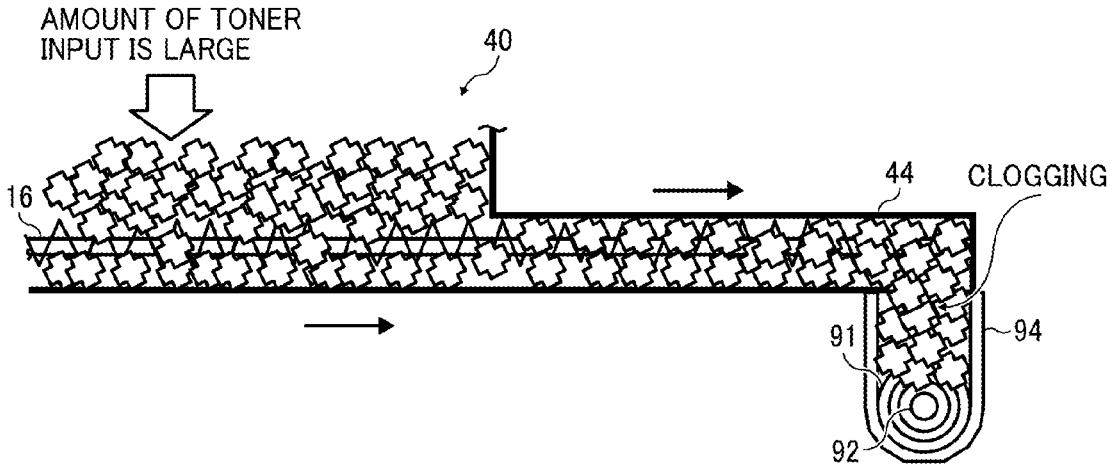
FIG. 8A is a schematic cross-sectional view of the waste-toner channel shown in FIGS. 7A and 7B, in a state in which the second toner is used.
Figure 8B:
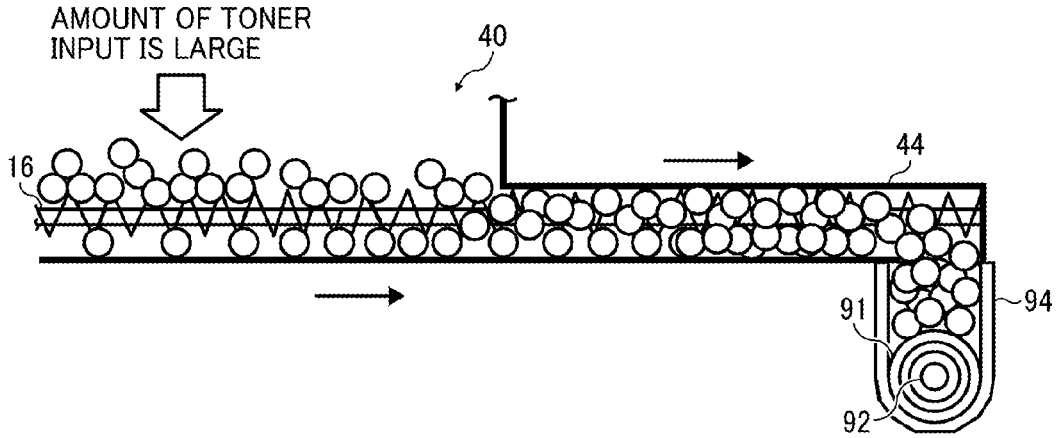
FIG. 8B is a schematic cross-sectional view of the waste-toner channel shown in FIG. 8A, in a state in which the first toner is used.
Figure 8C:
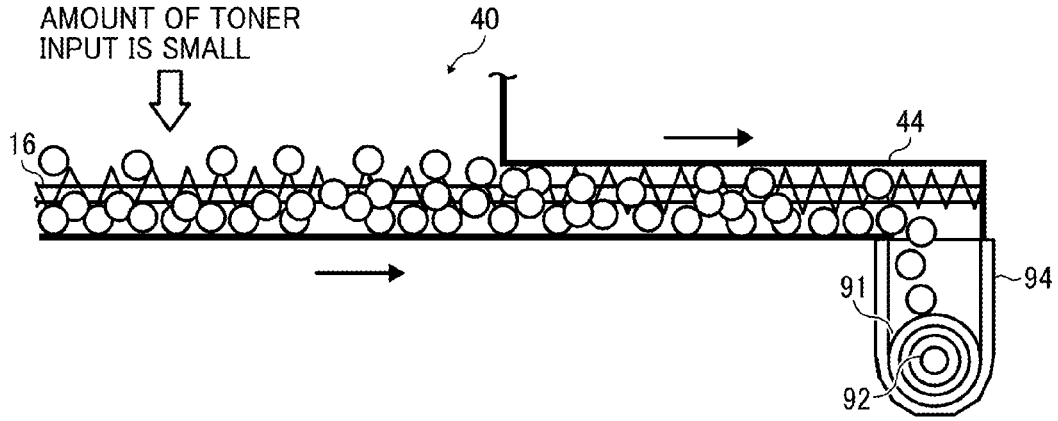
FIG. 8C is a schematic cross-sectional view illustrating changing a sheet interval area depending on toner type, according to an embodiment.

FIGS. 8A, 8B, and 8C are schematic cross-sectional views of the waste-toner conveying pipe 44 and the communicating pipe 94. FIG. 8A is a diagram illustrating inconveniences that arise when the second toner having poorer flow properties is used. FIG. 8B is a diagram illustrating inconveniences that arise when the first toner having better flow properties is used. FIG. 8C is a diagram illustrating widening a sheet interval area according to toner type.

When pulverized toner, which is less easily transported, is used, the toner discharge amount per unit time from the waste-toner conveying pipe 44 to the common conveying pipe 91 does not keep up with the amount of toner input from the cleaning device 40 as shown in FIG. 8A. Then, there arises the possibility of overflow of toner or clogging with toner of the waste-toner conveying pipe 44.

Additionally, as shown in FIG. 8B, even when polymerization toner, the flow properties of which are better, is used, it is possible that clogging with toner occurs in the communicating pipe 94, through which toner flows from the waste-toner conveying pipe 44 to the common conveying pipe 91.

In view of the foregoing, during continuous image formation in which images are successively formed on multiple number of recording sheets 6, an area between sheets (i.e., a sheet interval area) on the photoconductor 11 is widened depending on toner type used in the image forming unit 10 in the present embodiment. For example, the sheet interval area on the photoconductor 11 is adjusted by changing the timing at which the exposure device 4 exposes the photoconductor 11 or with idle running of the photoconductor 11.

With this operation, as shown in FIG. 8C, the amount of toner input from the cleaning device 40 to the waste-toner conveying pipe 44 is reduced, thereby suppressing the occurrence of overflow of toner or clogging with toner of the waste-toner conveying pipe 44. At that time, the amount per unit time of toner flowing from the waste-toner conveying pipe 44 to the common conveying pipe 91 decreases. Accordingly, the possibility of clogging of the communicating pipe 94, through which toner flows from the waste-toner conveying pipe 44 to the common conveying pipe 91, decreases.

To keep productively, it is advantageous that widening sheet interval areas is limited to cases where the amount of toner input to the cleaning device 40 is larger, such as image area ratio is greater and the toner adhesion amount to the photoconductor 11 is greater. If sheet interval areas are widened unnecessarily in cases where the amount of toner input is small, productivity is reduced.

Figure 9A:
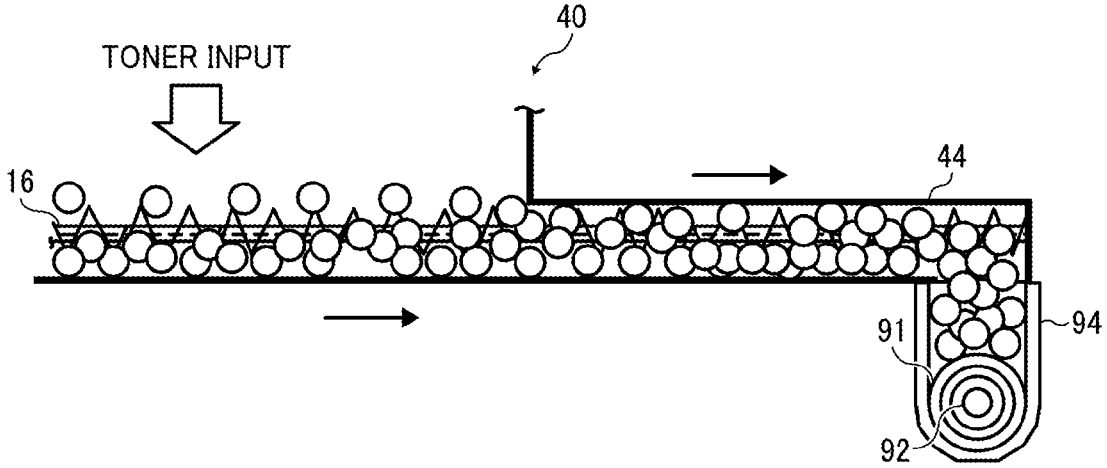
FIG. 9A is a schematic view of a state in which the amount of toner discharged from the waste-toner channel shown in FIG. 8A is excessive.

FIG. 9A is a schematic view of a state in which the amount of toner discharged from the waste-toner conveying pipe 44 of the cleaning device 40 to the common conveying pipe 91 is excessive.

If the amount of toner discharged from the waste-toner conveying pipe 44 to the common conveying pipe 91 is excessive, as shown in FIG. 9A, there is the possibility of clogging of the communicating pipe 94.

Figure 9B:
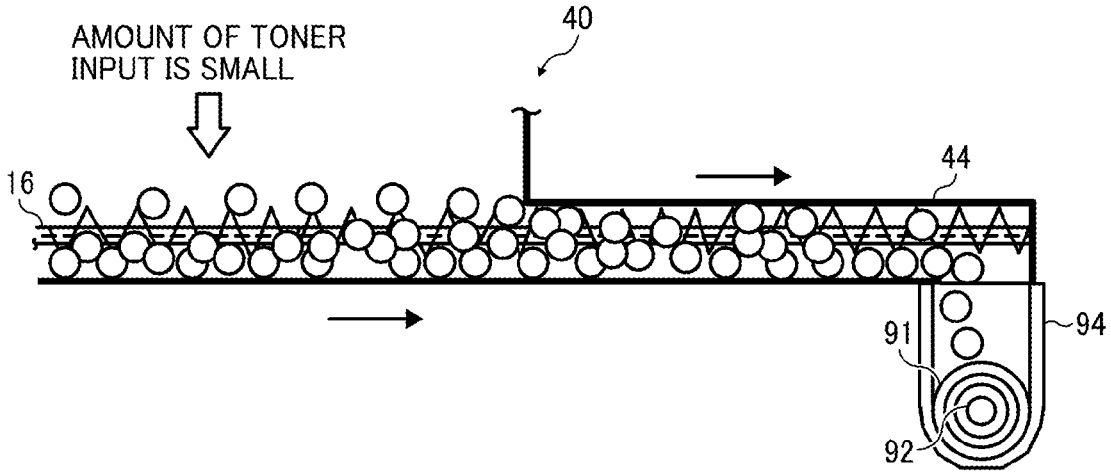
FIG. 9B is a schematic view illustrating increasing rotational speed of a conveying screw in a common conveyance channel according to an embodiment.

In view of the foregoing, in the present embodiment, as shown in FIG. 9B, the rotation speed of the conveying screw 92 disposed inside the common conveying pipe 91 is increased, thereby enhancing the transport capability of the conveying screw 92. Accordingly, clogging of the communicating pipe 94 with toner is inhibited.

Additionally, increasing the rotation speed of the conveying screw 92 is limited to cases where the amount of toner input to the cleaning device 40 is relatively large, such as when the image area ratio is large or toner adhesion amount to the photoconductor 11 is large. This control alleviates decreases in operational life of the conveying screw 92 caused by excessive rotation thereof.

Figure 10:
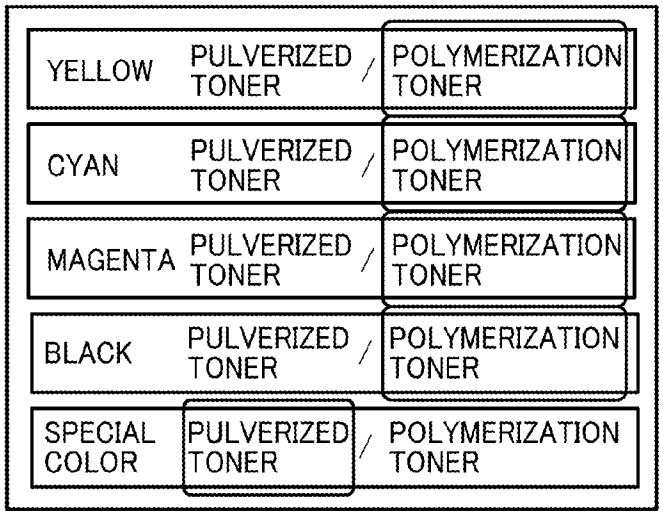
FIG. 10 is a schematic diagram illustrating setting of toner type according to an embodiment.

Referring to FIG. 10, setting of toner type is described below.

In the present embodiment, depending on toner type such as pulverized toner and polymerization toner, the rotation speed of the conveying screw 16, which is disposed in the waste-toner conveying pipe 44 of cleaning device 40, is changed. For the image forming apparatus 1 to recognize the toner type, toner types used in the respective image forming units 10 are prestored in software, for example.

As shown in FIG. 10, toner types selectable for use in the respective image forming units 10 appear, for example, on a control panel of the image forming apparatus 1, and users, operators, or the like designate the toner type used in each of the image forming units 10.

According to the designation of toner type (i.e., toner type data) in each image forming unit 10, the rotation speed of the conveying screw 16 is adjusted as described above.

Figure 11:
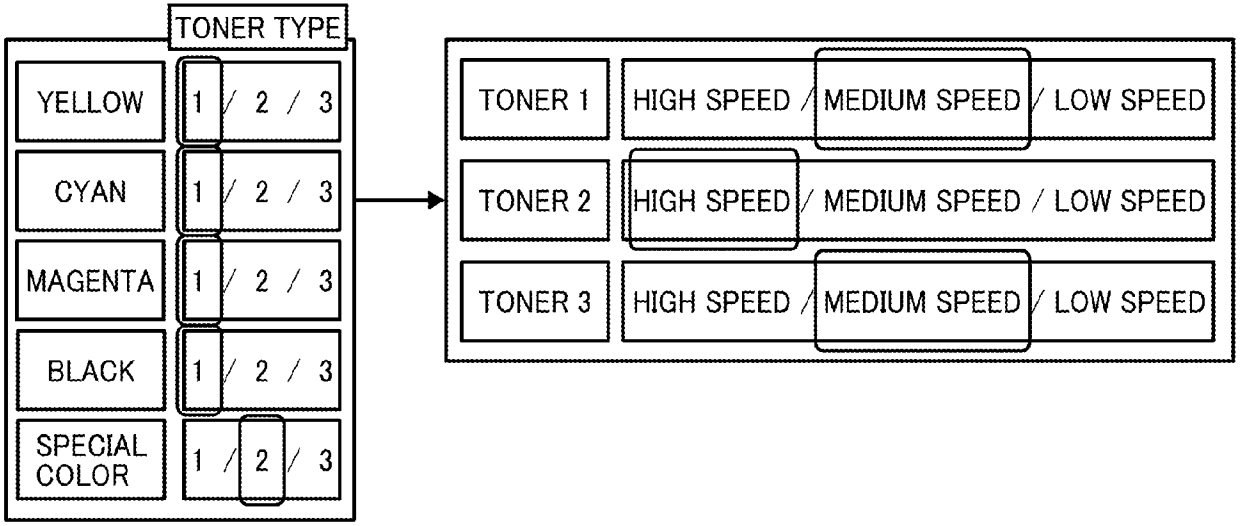
FIG. 11 is a schematic diagram illustrating setting of toner type according to another embodiment.

Referring to FIG. 11, setting of toner type according to another embodiment is described below.

In this case, as shown in FIG. 11, toner types usable in the respective image forming units 10 and the rotation speed of the conveying screw 16 corresponding to each toner type are preset. When the user or the like designates the toner type, for example, using the control panel, the rotation speed of the conveying screw 16 is determined for each image forming unit 10 according to the correlation between the toner type and the rotation speed of the conveying screw 16.

It is to be noted that, although rotation speed of the conveying screw 16 is selectable from three levels of high speed, medium speed, and low speed in FIG. 11, the number of levels are not limited thereto, and, alternatively, the rotational speed may be input in numbers.

Additionally, the controller 800 controls rotation of the conveying screw 92 in the common conveying pipe 91 and the conveying screw 96 in the horizontal conveyance channel 95 according to the number of the image forming units 10 in which conveyance speed of waste toner in the cleaning device 40 is increased from the reference speed.

Here, referring to FIG. 2, the common conveying pipe 91 includes a first portion 91*a* on the right (in FIG. 2) of the exit 91E, via which waste toner flows from the common conveying pipe 91 to the vertical conveyance channel 93, and a second portion 91*b* on the left (in FIG. 2) of the exit 91E.

The waste toner discharged from the cleaning devices 40K and 40M of the image forming units 10K and 10M flows through the first portion 91*a*. By contrast, the waste toner discharged from the cleaning devices 40C, 40Y, and 40S of the image forming units 10C, 10Y, and 10S flows through the second portion 91*b*.

It is to be noted that the number of the image forming units 10 corresponding to each of the first portion 91*a* and the second portion 91*b* is not limited thereto.

Generally, compared with a case where the rotation speed of the conveying screw 16 is increased in one of the cleaning devices 40K and 40M, the amount of waste toner transported through the first portion 91*a* is greater in a case where the speed is increased in both of the cleaning devices 40K and 40M.

As the number of the conveying screws 16 that are rotated at the increased speed increases, the amount of waste toner transported through the first portion 91*a* increases, and accordingly the rotation speed of the conveying screw 92 is increased in one embodiment.

Similarly, regarding the cleaning devices 40C, 40Y, and 40S, as the number of the conveying screws 16 that are rotated at the increased speed increases and accordingly the amount of waste toner transported through the second portion 91*b* increases, the rotation speed of the conveying screw 92 is increased in one embodiment.

It is to be noted that, in the configuration shown in FIG. 2, a common conveying screw transports waste toner through the first portion 91*a* and the second portion 91*b* of the common conveying pipe 91. In this configuration, the rotation speed of the conveying screw 92 is set corresponding to the greater of amounts of waste toner transported in the first portion 91*a* and the second portion 91*b*.

For example, in a case where the image forming units 10K and 10S employ pulverized toner and the image forming units 10Y, 10C, and 10M employ polymerization toner, the rotation speed of the conveying screw 92 in the common conveying pipe 91 is controlled as follows.

In this case, the conveying screws 16K and 16S to transport pulverized toner are rotated at an increased speed from the rotation speed of the conveying screw 16Y, 16C, and 16M to transport polymerization toner. For example, in the image forming units 10K and 10S, the conveying screws 16K and 10S are rotated at the speed higher than a reference speed.

In the first portion 91*a*, only one image forming unit 10 (10K) contributes to the increase in rotation speed of the conveying screw 92.

In the second portion 91*b*, only one image forming unit 10 (10S) contributes to the increase in rotation speed of the conveying screw 92.

Thus, in each of the first portion 91*a* and the second portion 91*b*, the number of image forming units 10 contributing to the increase in rotation speed of the conveying screw 92 is one. Accordingly, the rotation speed of the conveying screw 92 is set at a speed corresponding to a case where there is one image forming unit 10 including the conveying screw 16 to rotate at the increased speed.

By contrast, two image forming units 10, namely, the image forming units 10K and 10S contribute to the increase in rotation speed of the conveying screw 96 disposed in the horizontal conveyance channel 95. Accordingly, the rotation speed of the conveying screw 96 is set at a speed corresponding to a case where there are two image forming units 10 each including the conveying screw 16 to rotate at the increased speed.

Alternatively, in a case where the image forming units 10Y and 10S employ pulverized toner and the image forming units 10C, 10M, and 10K employ polymerization toner, the rotation speed of the conveying screw 92 in the common conveying pipe 91 is controlled as follows.

In this case, the conveying screw 16Y and 16S to transport pulverized toner are rotated at an increased speed from the rotation speed of the conveying screw 16C, 16M, and 16K to transport polymerization toner. That is, in the image forming units 10Y and 10S, the conveying screws 16Y and 10S are rotated at the speed higher than the reference speed.

In the first portion 91*a*, no image forming unit 10 contributes to the increase in rotation speed of the conveying screw 92 since the conveying screws 16M and 16K corresponding to the first portion 91*a* are not rotated at the increased speed.

In the second portion 91*b*, two image forming units 10, namely, the image forming units 10Y and 10S contribute to the increase in rotation speed of the conveying screw 92.

Thus, the number of the image forming units 10 contributing to the increase in rotation speed of the conveying screw 92 is zero in the first portion 91*a*, and two in the second portion 91*b*. Accordingly, the rotation speed of the conveying screw 96 is set at a speed corresponding to the second portion 91*b* in which the number of image forming units 10 each of which includes the conveying screw 16 to rotate at the increased speed is two.

By contrast, two image forming units 10, namely, the image forming units 10Y and 10S, contribute to the increase in rotation speed of the conveying screw 96 disposed in the horizontal conveyance channel 95. Accordingly, the rotation speed of the conveying screw 96 is set at a speed corresponding to a case where there are two image forming units 10 each of which includes the conveying screw 16 to rotate at the increased speed.

It is to be noted that the description above concerns the configuration in which the conveying screw 92 in the common conveying pipe 91 and the conveying screw 96 in the horizontal conveyance channel 95 are rotated by separate driving sources, and control of the rotational speed thereof are separately described above.

Alternatively, in one embodiment, the conveying screw 92 and the conveying screw 96 are rotated by a common driving source. In this case, the rotational speed of both of the conveying screw 92 and the conveying screw 96 is set according to the number of the image forming units 10 each of which includes the conveying screw 16 to rotate at the increased speed, simply out of all image forming units 10.

In this case, similar to the description above, the criteria for increasing the rotation speed of the conveying screw 92 include the amount of toner input to the cleaning device 40, image area ratio, and the toner adhesion amount to the photoconductor 11.

In other words, in the common conveying pipe 91, the rotation speed of the conveying screw 92 is increased when the image area ratio or the toner adhesion amount, summed up in each of the first portion 91*a* and the second portion 91*b*, exceeds a threshold. Additionally, in the horizontal conveyance channel 95, the rotation speed of the conveying screw 96 is increased when the image area ratio or the toner adhesion amount summed up in all image forming units 10 exceeds a threshold.

Second Embodiment

A second embodiment is described below with reference to drawings.

The image forming apparatus 1 according to the present embodiment has a configuration similar to that according to the first embodiment, an example of which is shown in FIG. 2. Additionally, the image forming units 10 according to the present embodiment have configurations similar to those according to the first embodiment, an example of which is shown in FIGS. 3 and 4.

It is to be noted that, in the present embodiment, process color toners, namely, yellow (Y), cyan (C), magenta (M), and black (K) are polymerization toners, and transparent toner is pulverized toner, similar to the above-described first embodiment. Alternatively, in one embodiment, toner type is selectable from polymerization toner and pulverized toner for each image forming unit 10. In this case, toner type is set, for example, as described above with reference to FIG. 10.

Differences of the present embodiment from the above-described first embodiment are as follows.

The conveying screw 16 and the application roller 51 are rotated by either a common driving source (i.e., the driving motor 51M) or separate driving sources in the first embodiment. In the present embodiment, however, the conveying screw 16 and the application roller 51 are rotated by a common driving source not separate driving sources.

Additionally, in the present embodiment, the temperature and humidity sensor 203 is used in controlling the transport of waste toner. The temperature and humidity sensor 203 measures absolute humidity that represents an environment in which the image forming apparatus 1 is installed.

Descriptions are given below of determination of rotation speed (the number of revolutions per minute or RPM) of the driving motor 51M.

To protect the surface of the photoconductor 11 with lubrication by the application roller 51, the rotation speed of the driving motor 51M is determined in view of effects of absolute humidity under which the image forming apparatus 1 is used.

Figure 12A:
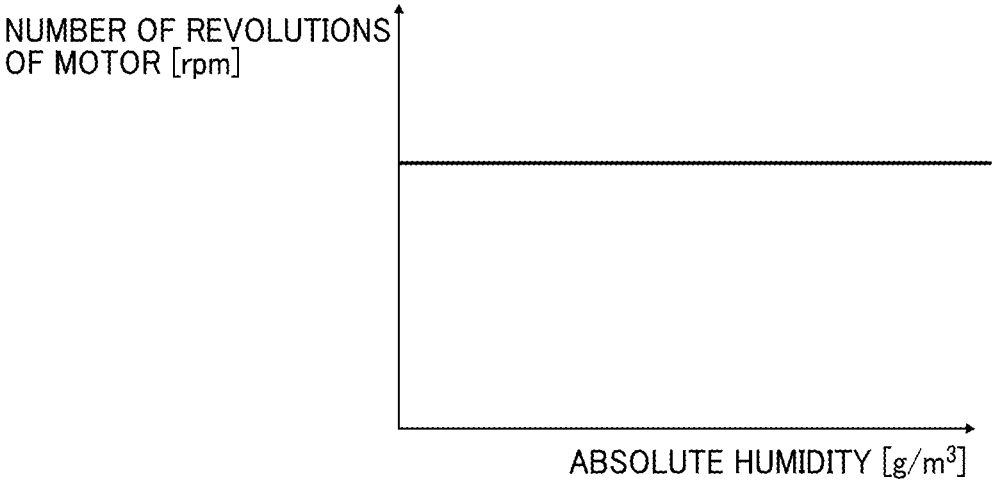
FIG. 12A is a graph of number of revolutions per minute (i.e., a motor speed) kept constant regardless of absolute humidity.
Figure 12B:
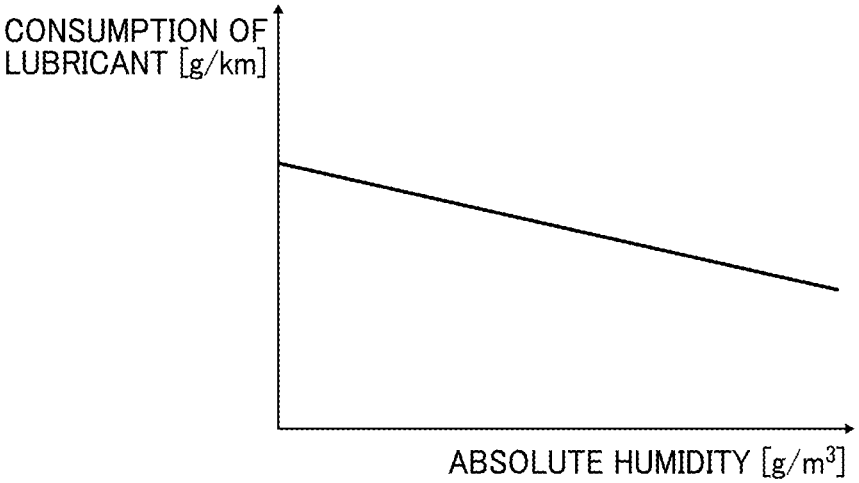
FIG. 12B is a graph of consumption of lubricant relative to the absolute humidity when the motor speed is constant.
Figure 13A:
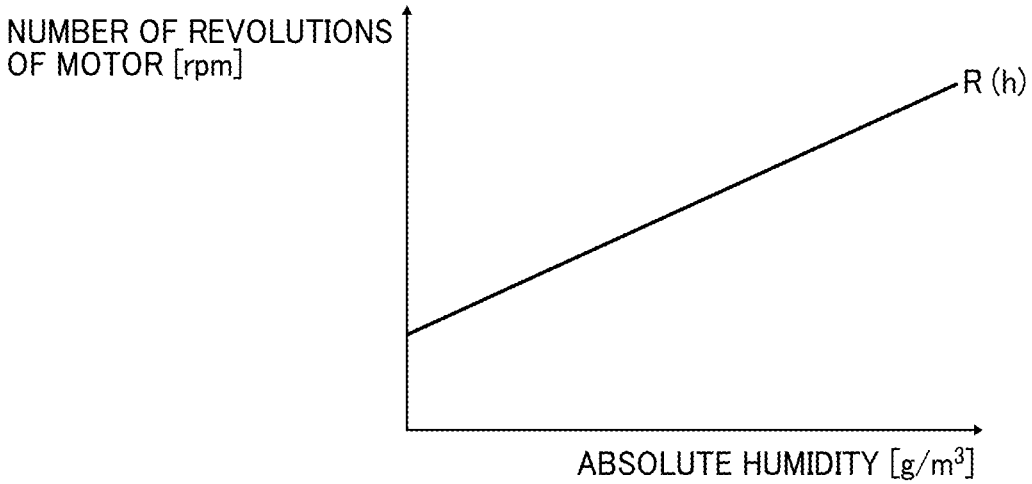
FIG. 13A is a graph of motor speed to drive an application roller relative to the absolute humidity according to an embodiment.
Figure 13B:
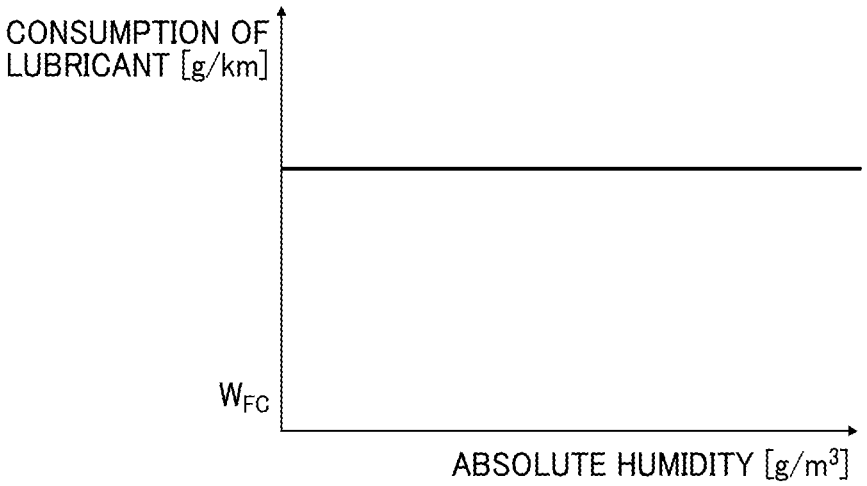
FIG. 13B is a graph of consumption of lubricant relative to the absolute humidity when the motor speed is varied as shown in FIG. 13A.

FIGS. 12A and 13A are graphs of relations between the absolute humidity and the rotation speed of the driving motor 51M to drive the application roller 51. FIGS. 12B and 13B are graphs of relations between the absolute humidity and the consumption of lubricant. It is to be noted that the term "consumption of lubricant" used here means the amount of lubricant that the application roller 51 scraped off from the solid lubricant 50.

As shown in FIG. 12A, when the rotational speed of the application roller 51 is constant, the consumption of lubricant decreases as the absolute humidity rises. Specifically, as shown in FIG. 12B, as the absolute humidity increases, the consumption of lubricant decreases in inverse proportion to the absolute humidity. It is preferred the consumption of lubricant be constantly equal to or greater than an amount to maintain desirable lubrication to protect the surface of the photoconductor 11. In a case where the rotation speed of the driving motor 51M is kept constant, when the absolute humidity rises, it is possible that the consumption of lubricant falls below the amount to maintain desirable lubrication of the surface of the photoconductor 11 during cleaning. Thus, it is possible that the surface of the photoconductor 11 is not protected with lubricant sufficiently during cleaning.

Referring to FIG. 13A, by increasing the rotation speed of the driving motor 51M in proportional to the absolute humidity rise, the consumption of lubricant is kept constant in spite of the absolute humidity rise as shown in FIG. 13B. That is, the rotation speed of the driving motor 51M is increased in proportional to the absolute temperature rise to keep the consumption of lubricant at a constant amount equal to or greater than the amount to maintain desirable lubrication of the photoconductor 11. Then, during cleaning, the surface of the photoconductor 11 is protected with lubricant.

In one embodiment, the rotation speed (i.e., RPM) of the driving motor 51M corresponding to absolute humidity h, which is hereinafter referred to as "motor revolution number R(h), differs depending on toner type. For example, $r_{FC}(h)$ represents the motor speed (motor revolution number) to maintain desirable lubrication of the photoconductor 11 when polymerization toner is used, and $r_S(h)$ represents the motor speed (motor revolution number) to maintain desirable lubrication when pulverized toner is used.

In the configuration in which the conveying screw 16 and the application roller 51 are driven by a common driving motor (i.e., the driving motor 51M), the motor speed is determined considering driving of the conveying screw 16 to maintain reliable transport of waste toner, in addition to driving of the application roller 51 to maintain desirable lubrication of the photoconductor 11.

Figure 14A:
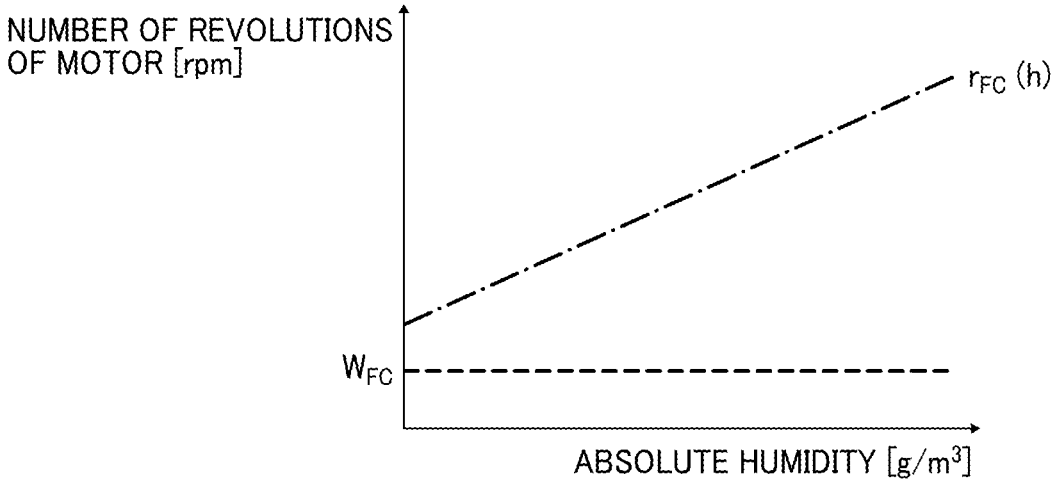
FIGS. 14A and 14B are graphs of relations between the absolute humidity and the motor speed to drive the application roller shown in FIG. 3 when polymerization toner is used.
Figure 14B:
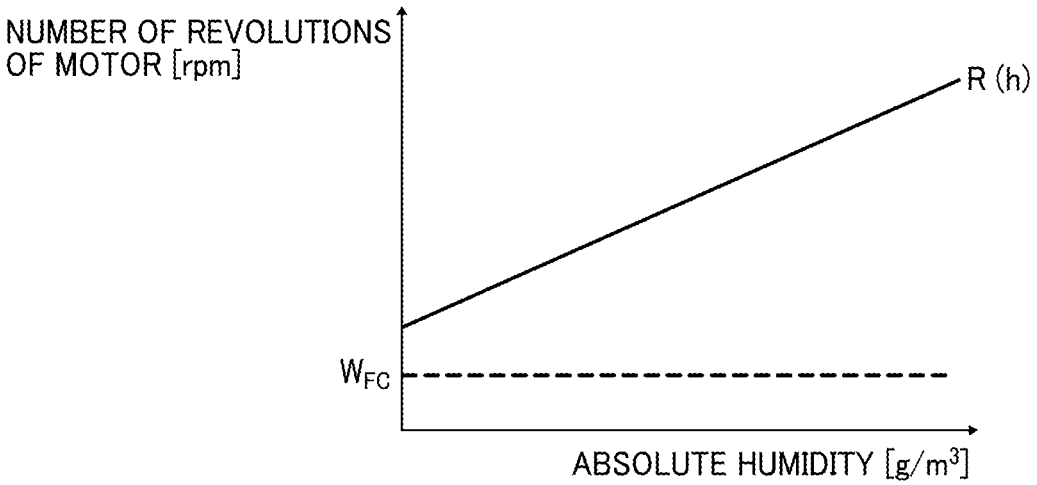

FIGS. 14A and 14B relate to determination of motor speed in the cleaning device 40 in the image forming unit 10 using polymerization toner.

In FIG. 14A, alternate long and short dashed lines represent the revolution number of the driving motor 51M to maintain desirable lubrication of the photoconductor 11 in relation to the absolute humidity, and, and broken lines represent the revolution number to maintain reliable transport of waste toner in relation to the absolute humidity.

As described above, the revolution number $r_{FC}(h)$ to maintain desirable lubrication for polymerization toner, which is also referred to a "revolution number $r_{FC}(h)$ for lubrication", increases in proportion to the rise in the absolute humidity h. By contrast, the motor speed to maintain reliable transport of waste toner in the case of polymerization toner, which is also referred to as "revolution number $W_{FC}$ for transport of toner", is constant and independent of the absolute humidity.

When polymerization toner is used, regardless of the absolute humidity h, constantly a relation $r_{FC}(h)>W_{FC}$ is established. Accordingly, the motor revolution number R(h) is set at $r_{FC}(h)$, indicated by a solid line in FIG. 14B, to attain both of desirable lubrication of the photoconductor 11 and reliable transport of waste toner.

Figure 15A:
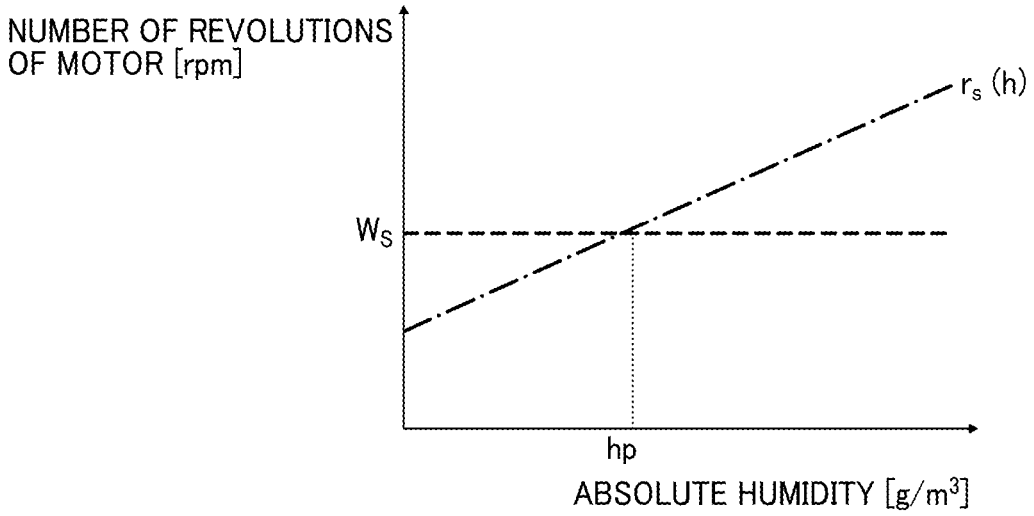
FIGS. 15A and 15B are graphs of relations between absolute humidity and motor speed to drive the application roller shown in FIG. 3 when pulverized toner is used.
Figure 15B:
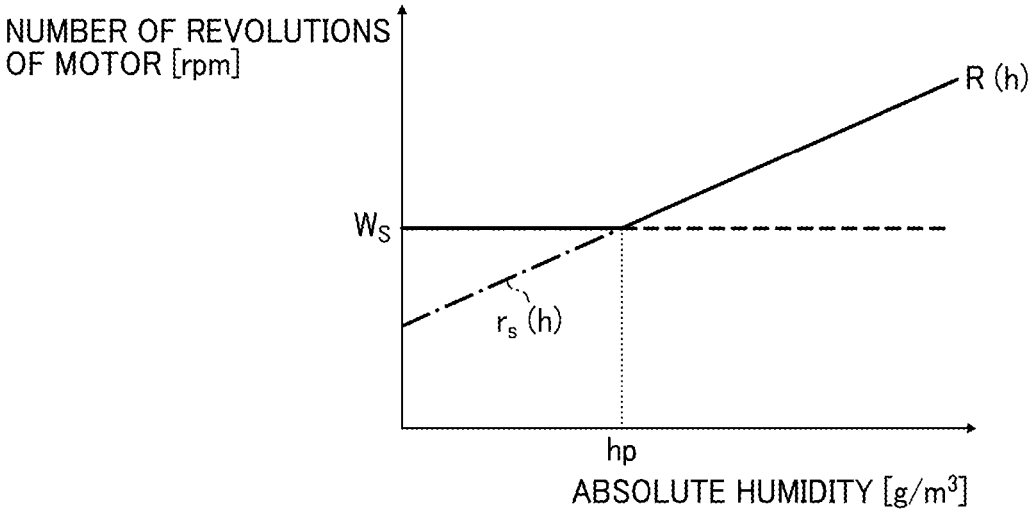

FIGS. 15A and 15B relate to determination of motor speed when pulverized toner is used.

In FIG. 15A, alternate long and short dashed lines represent motor speed to maintain desirable lubrication when pulverized toner is used, in relation to the absolute humidity, and broken lines represent revolution number to maintain reliable transport of waste toner when pulverized toner is used, in relation to the absolute humidity.

Also when pulverized toner is used, the revolution number $r_S$ (h) of the driving motor 51M to maintain desirable lubrication, which is also referred to as "revolution number $r_S$ (h) for lubrication, increases in proportion to the rise in the absolute humidity h. In addition, the motor speed to maintain reliable transport of waste toner in the case of pulverized toner, which is also referred to as "revolution number $W_S$ for transport of toner", is constant and independent of the absolute humidity similar to the cases where polymerization toner is used.

In FIG. 15A, the relation of magnitude between $r_S(h)$ and $W_S$ is inverted at absolute humidity hp. In the image forming unit 10 using pulverized toner, when the absolute humidity is greater than hp, $r_S(h)\geq W_S$. Thus, the motor revolution number R(h) is set at $r_S(h)$. By contrast, when the absolute humidity is smaller than hp, $r_S(h)\leq W_S$, and thus the motor revolution number R(h) is set at $W_S$. Thus, the motor revolution number R(h) is set as indicated by a solid line in FIG. 15B.

In practice, the motor speed is generally changed stepwise, not continuously, relative to the absolute humidity. For example, when absolute temperature range is divided in five ranges as in table 1 below, the revolution number $r_{FC}(h)$ for lubrication, represented by alternate long and short dashed lines in FIG. 14A, is converted to $R_{FC}(h)$ represented by stepwise solid lines in FIG. 16A. The revolution number $r_S(h)$ for lubrication, represented by alternate long and short dashed lines in FIG. 15A, is converted to the revolution number $R_S(h)$ represented by solid lines in FIG. 16B. It is to be noted that the absolute humidity is divided differently in another embodiment.

TABLE 1

| ABSOLUTE HUMIDITY | NUMBER OF REVOLUTIONS FOR LUBRICATION | |
|---|---|---|
| | POLYMERIZATION TONER $R_{FC}$ (h) | PULVERIZED TONER $R_S$ (h) |
| h < h1 | $R_{FC}1$ | $R_S1$ |
| h1 ≤ h < h2 | $R_{FC}2$ | $R_S2$ |
| h2 ≤ h < h3 | $R_{FC}3$ | $R_S3$ |
| h3 ≤ h < h4 | $R_{FC}4$ | $R_S4$ |
| h4 ≤ h | $R_{FC}5$ | $R_S5$ |

In table 1, absolute temperature is divided in five ranges of h<h1, h1≤h<h2, h2≤h<h3, h3<h<h4, and h4<h (h1<h2<h3<h4<h5).

The revolution number $R_{FC}(h)$ in the case of polymerization toner to maintain desirable lubrication of the photoconductor 11 is set at $R_{FC}$1, $R_{FC}$2, $R_{FC}$3, $R_{FC}$4, and $R_{FC}$5 respectively for the five ranges of absolute humidity in the order mentioned above ($R_{FC}$1<$R_{FC}$2<$R_{FC}$3<$R_{FC}$4<$R_{FC}$5).

The revolution number $R_S(h)$ in the case of pulverized toner to maintain desirable lubrication of the photoconductor 11 is set at $R_S$1, $R_S$2, $R_S$3, $R_S$4, and $R_S$5 respectively for the five ranges of absolute humidity in the order mentioned above ($R_S$5>$W_S$>$R_S$4>$R_S$3>$R_S$2>$R_S$1). The correlation between the absolute humidity range and the motor speed to maintain desirable lubrication of the photoconductor 11, for each toner type, is prestored in data storage device inside the image forming apparatus 1.

Figure 16A:
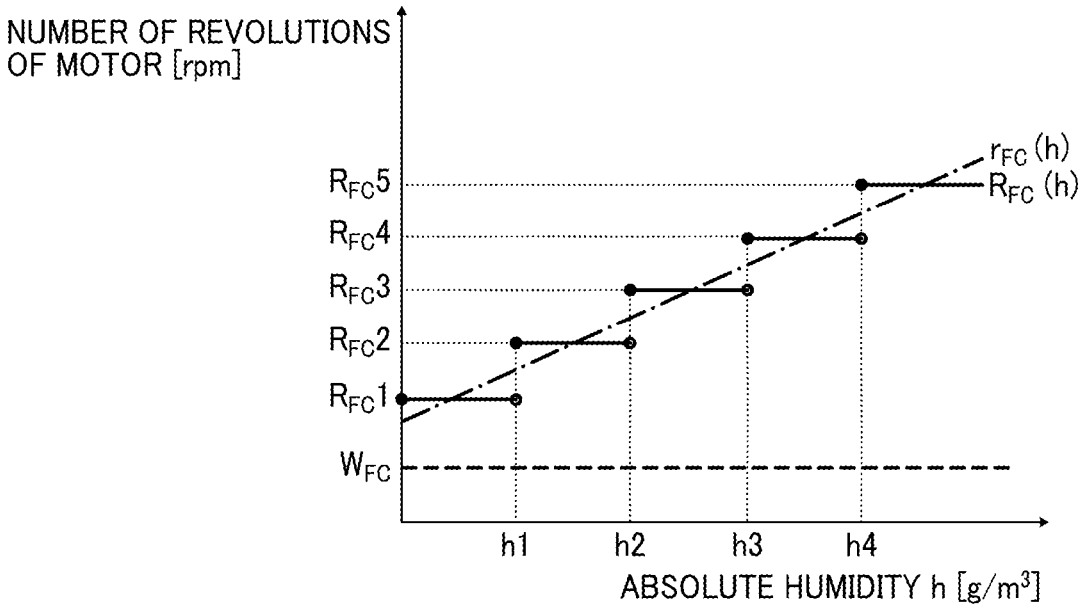
FIGS. 16A and 16B are graphs of stepwise change in the motor speed corresponding to absolute humidity ranges, according to an embodiment.

The graph shown in FIG. 16A for the case of polymerization toner includes, in addition to $R_{FC}(h)$ indicated by the stepwise solid lines, $r_{FC}$ represented by the slant graph of alternate long and short dashed lines and $W_{FC}$ represented by the horizontal graph of broken lines in FIG. 14A. Similarly, the graph shown in FIG. 16B for the case of pulverized toner includes, in addition to the revolution number $R_S(h)$ indicated by the solid lines, the revolution number $r_S(h)$ indicated by alternate long and short dashed lines in FIG. 15A and rotation speed $W_S$ indicated by broken lines in FIG. 15A.

When polymerization toner is used, relative to the absolute humidity h, the relation $R_{FC}$ (h)>$W_{FC}$ is constantly established (see FIG. 16A). Accordingly, the motor revolution number R(h) is set at $R_{FC}(h)$.

Figure 16B:
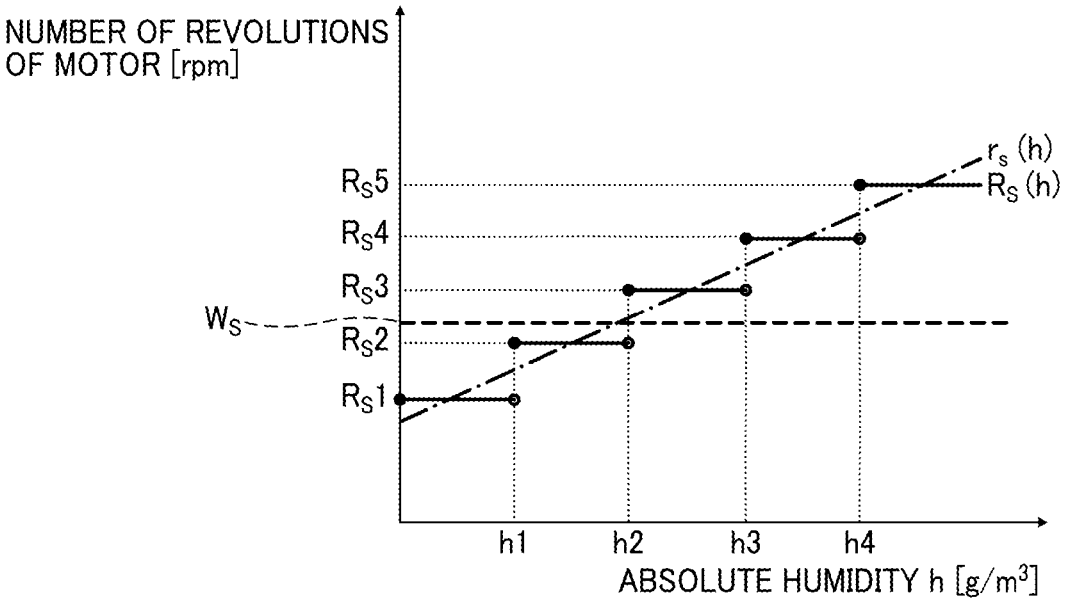

By contrast, when pulverized toner is used, $R_S(h)<W_S$ is true depending on the absolute humidity h. For example, as shown in FIG. 16B, when $R_S$2, $R_S$3, and $W_S$ are in the relation of $R_S$3>$W_S$>$R_S$2, $R_S(h)<W_S$ is true when the absolute humidity h is not greater than h2 (at any of ranges of h<h1 and h1≤h<h2). Thus, the motor revolution number R(h) is set at $W_S$ when the absolute humidity h is not greater than h2. When the absolute humidity h is greater than h2 (at any of ranges of h2≤h<h3, h3≤h<h4, and h4<h), the motor revolution number R(h) is set at $R_S(h)$.

Descriptions are given below of control flow of the motor revolution number R(h).

Figure 17:
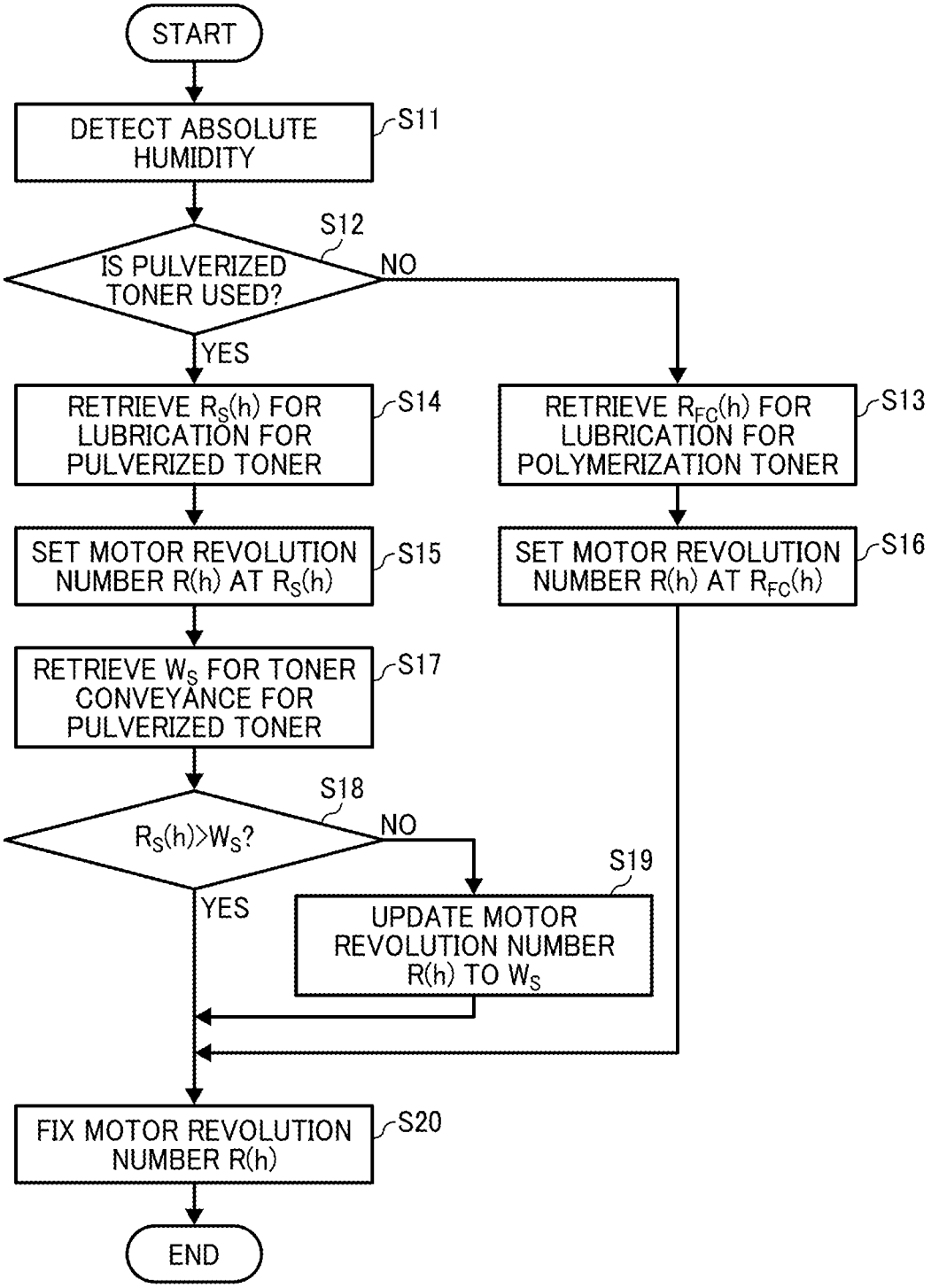
FIG. 17 is a flowchart of a sequence of processes to determine the motor speed, according to an embodiment.

FIG. 17 is a flowchart of a sequence of processes to determine the motor revolution number R(h).

At S11, the temperature and humidity sensor 203 of the image forming apparatus 1 detects the absolute humidity in the environment in which the apparatus is used.

At S12, the controller 800 identifies toner type in that image forming unit 10. In FIG. 17, whether or not pulverized toner is used is judged. When pulverized toner is used (Yes at S12), the process proceeds to S14. When polymerization toner is used, the process proceeds to S13.

At S13, from the correlation prestored in the data storage device, the revolution number $R_{FC}(h)$ for lubrication for polymerization toner, corresponding to the absolute humidity detected at S11 is retrieved. At S16, the motor revolution number R(h) is set at $R_{FC}(h)$.

At S14, from the correlation prestored in the data storage device, the revolution number $R_S(h)$ for lubrication for pulverized toner, corresponding to the absolute humidity detected at S11 is retrieved. At S15, the motor revolution number R(h) is set at $R_S(h)$.

At S17, from the correlation prestored in the data storage device, the revolution number $W_S(h)$ for toner conveyance for pulverized toner, corresponding to the absolute humidity detected at S11 is retrieved. At S18, the value of $R_S(h)$, to which the motor revolution number R(h) is set at S15, is compared with the value of $W_S$ retrieved at S17. When $R(h)>W_S$, the possibility of clogging with waste toner is low, and at S20, R(h) is fixed at $R_S(h)$. By contrast, when $R(h)\leq W_S$, clogging with waste toner is possible with R(h) fixed at $R_S(h)$. Accordingly, at S19, R(h) is updated to $W_S$ and fixed at S20.

The process from S12 through S20 is performed for each of the multiple cleaning devices 40.

Typically, the motor revolution number ($R_{FC}$1, $R_{FC}$2, $R_{FC}$3, $R_{FC}$4, and $R_{FC}$5) for the cases of polymerization toner and the motor revolution number ($R_S$1, $R_S$2, $R_S$3, $R_S$4, and $R_S$5) for pulverized toner are in the relation of magnitude of $R_{FC}$1≥$R_S$1, $R_{FC}$2≥$R_S$2, $R_{FC}$3≥$R_S$3, $R_{FC}$4≥$R_S$4, and $R_{FC}$≥5≥$R_S$5. When the difference between $R_{FC}$n and $R_S$n (n=1 to 5) is small and ignorable in practice, $R_S$n for each cleaning device 40 is set at a value equal to the value of $R_{FC}$n in one embodiment. This setting is advantageous in simplifying the process to determine the motor speed since an identical revolution number is applied to all of the cleaning devices 40 of the image forming units 10 employing polymerization toner or pulverized toner when the apparatus is used under the absolute humidity greater than hp (shown in FIGS. 15A and 15B).

In the present embodiment, lubricant applied to the photoconductor 11 is scraped by the application roller 51 from the solid lubricant 50 produced by mixing zinc stearate, boron nitride, and alumina and compressing the mixture. Use of zinc stearate as fatty acid metallic salt added to lubricant is advantageous in enhancing the capability of lubricant to suppress degradation with time of image bearers, thereby inhibiting poor cleaning. Use of boron nitride as inorganic lubricant added to lubricant is advantageous in enhancing the capability of lubricant to suppress degradation with time of the cleaning blade 43 and the charging roller 22, thereby inhibiting poor cleaning.

As mentioned in the first embodiment, if the rotation speed of the conveying screw 16 is increased constantly aiming at improving the capability of the conveying screw 16 to transport waste toner, it is possible that the operational life of the conveying screw 16 is shortened due to excessive rotation thereof. Additionally, as in the present embodiment in which the conveying screw 16 and the application roller 51 are driven by a common driving source (i.e., the driving motor 51M), the rotation speed of the application roller 51 increases as the rotation speed of the conveying screw 16 increases. Accordingly, it is possible that the life of the solid lubricant 50 is shortened, or the charging roller 22 is stained due to excessive lubrication of the photoconductor 11, thus shortening the operational life of the charging roller 22.

Therefore, in one embodiment, increasing the rotation speed of the conveying screw 16 is limited to cases where the amount of toner removed from the photoconductor 11 by the cleaning device 40 is relatively large, such as when the image area ratio is large or toner adhesion amount to the photoconductor 11 is large.

Additionally, similar to the first embodiment, the image forming apparatus 1 according to the present embodiment can have a capability of widening the sheet interval area on the photoconductor 11 depending on toner type used in that image forming unit 10 during continuous image formation. It is preferred this operation be limited to cases where the amount of toner input to the cleaning device 40 is relatively large, such as when the image area ratio is large or toner adhesion amount to the photoconductor 11 is large.

Third Embodiment

A third embodiment is described below with reference to drawings.

The image forming apparatus 1 according to the present embodiment is similar to that according to the first embodiment, an example of which is shown in FIG. 2. Additionally, the image forming unit 10 according to the present embodiment is similar to that according to the first embodiment, an example of which is shown in FIGS. 3 and 4.

It is to be noted that, in the present embodiment, process color toners, namely, yellow (Y), cyan (C), magenta (M), and black (K) are polymerization toners, and transparent toner is pulverized toner, similar to the above-described first embodiment. In one embodiment, toner type is selectable from polymerization toner and pulverized toner for each image forming unit 10. In this case, toner type is set, for example, as described above with reference to FIG. 10.

Differences of the present embodiment from the above-described first embodiment are as follows.

The conveying screw 16 and the application roller 51 are rotated by either a common driving source or separate driving sources in the first embodiment. In the present embodiment, however, the conveying screw 16 and the application roller 51 are rotated by a common driving source, the driving motor 51M.

Additionally, the image forming apparatus 1 according to the present embodiment includes the temperature and humidity sensor 203. The temperature and humidity sensor 203 measures the absolute humidity that represents an environment in which the image forming apparatus 1 is installed. Additionally, before image formation, the controller 800 sets the amount of pulverized toner applied to the surface of the photoconductor 11 (hereinafter "pulverized toner adhering amount"). For example, the controller 800 calculates the pulverized toner adhering amount based on image-related data input to the image forming apparatus 1, such as image density setting made by the user or image data of images to be formed. According to the pulverized toner adhering amount thus set, a computing unit 901 calculates the motor speed to maintain reliable transport of waste toner (i.e., motor revolution number for toner conveyance).

Descriptions are given below of determination of number of revolutions of the driving motor.

Determination of number of revolutions of the driving motor 51M in the image forming unit 10 using polymerization toner is similar to that described with reference to FIGS. 14A and 14B. By contrast, determination of number of revolutions of the driving motor 51M in the image forming unit 10 using pulverized toner is different from that described with reference to FIGS. 15A and 15B in that pulverized toner adhering amount is considered.

Referring to FIGS. 18A through 18D, descriptions are given below of determination of number of revolutions of the driving motor 51M of the cleaning device 40 in the image forming unit 10 using pulverized toner.

In the example shown in FIGS. 18A through 18D, there are three settings of pulverized toner adhering amount, large amount, standard amount, and small amount, and three settings $W_S$max, $W_S$mid, and $W_S$min for the motor speed for transport of toner, respectively corresponding to the settings of large amount, standard amount, and small amount.

Figure 18A:
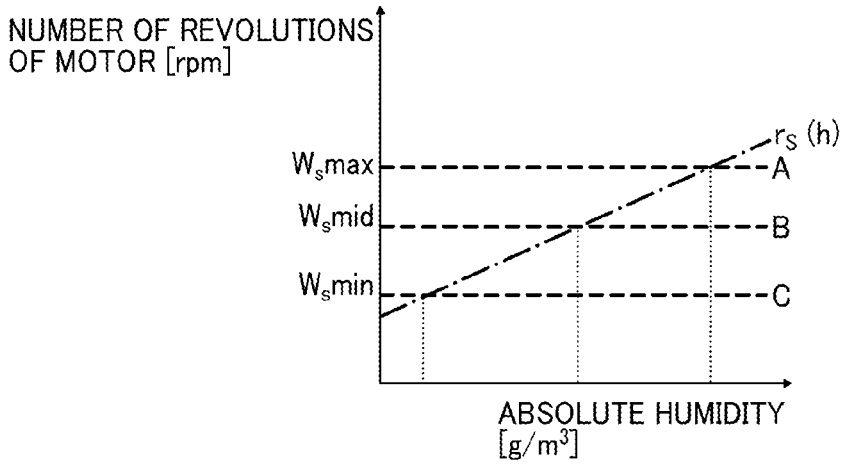
FIGS. 18A through 18D are graphs for understanding of the motor speed in relation to the absolute humidity and adhering amount of pulverized toner.

In FIG. 18A, alternate long and short dashed lines represent the motor speed to maintain desirable lubrication of the photoconductor 11 (i.e., motor speed for lubrication) in relation to the absolute humidity, and graphs A through C (broken lines) represent the motor speed for transport of toner in relation to the absolute humidity.

The motor speed for transport of toner varies depending on the pulverized toner adhering amount set before image formation. The graph A in FIG. 18A represents the motor speed for transport of toner when the pulverized toner adhering amount is set at the large amount. The graphs B and C in FIG. 18A represents the motor speeds for transport of toner when the pulverized toner adhering amount is set at the standard amount and the small amount, respectively.

In the case of pulverized toner, similar to the case of polymerization toner, the motor speed for lubrication increases in proportion to the rise in the absolute humidity h, which is referred to as "revolution number $r_S(h)$ for lubrication. In addition, the motor speed to maintain reliable transport of waste toner in the case of pulverized toner, which is referred to as revolution number $W_S$ for transport of toner, is constant and independent of the absolute humidity similar to the case of polymerization toner. The constant revolution number, however, varies depending on the pulverized toner adhering amount. The revolution number $W_S$ in relation to the pulverized toner adhering amount is set at $W_S$max, $W_S$mid, and $W_S$min when the pulverized toner adhering amount set at the large amount, the standard amount, and the small amount, respectively.

Figure 18B:
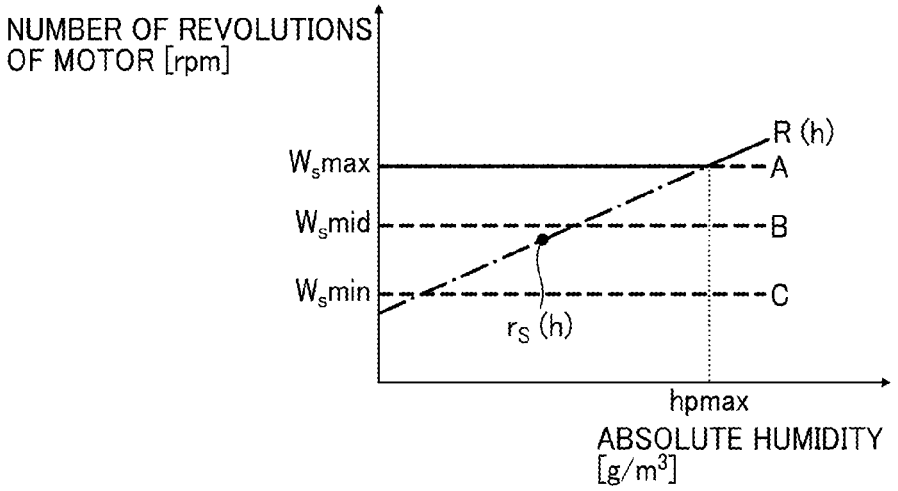

In the case where the pulverized toner adhering amount is set at the large amount, the relation of magnitude between $r_S(h)$ and $W_S$max is inverted at absolute humidity hpmax in FIG. 18B. In the image forming unit 10 using pulverized toner, when the absolute humidity is greater than hpmax, the relation $r_S(h) \geq W_S$mas is true, and the motor revolution number R(h) is set at $r_S(h)$. By contrast, when the absolute humidity is smaller than hpmax, the relation $r_S(h) \leq W_S$max is true, and the motor revolution number R(h) is set at $W_S$max. Thus, the motor revolution number R(h) is set as indicated by a solid line in FIG. 18B.

Figure 18C:
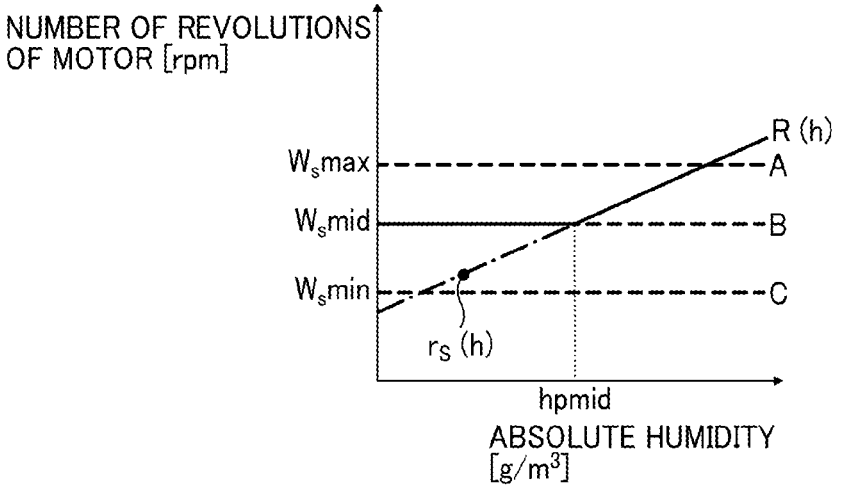

In the case where the pulverized toner adhering amount is set at the standard amount, the relation of magnitude between $r_S(h)$ and $W_S$mid is inverted at absolute humidity hpmid in FIG. 18C. In the image forming unit 10 using pulverized toner, when the absolute humidity is greater than the value hpmid, the relation $r_S(h) \geq W_S$mid is true, and the motor revolution number R(h) is set at $r_S(h)$. By contrast, when the absolute humidity is smaller than hpmid, the relation $r_S(h) \leq W_S$mid is true, and the motor revolution number R(h) is set at $W_S$mid. Thus, the motor revolution number R(h) is set as indicated by a solid line in FIG. 18C.

Figure 18D:
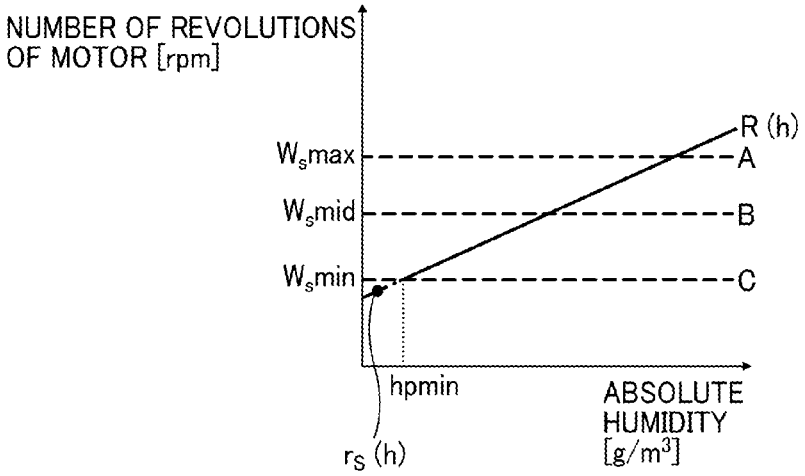

In the case where the pulverized toner adhering amount is set at the small amount, the relation of magnitude between $r_S(h)$ and $W_S$min is inverted at absolute humidity hpmin in FIG. 18D. In the image forming unit 10 using pulverized toner, when the absolute humidity is greater than the value hpmin, the relation $r_S(h) \geq W_S$min is true, and the motor revolution number R(h) is set at $r_S(h)$. By contrast, when the absolute humidity is smaller than hpmin, the relation $r_S(h) < W_S$min is true, and the motor revolution number R(h) is set at $W_S$min. Thus, the motor revolution number R(h) is set as indicated by a solid line in FIG. 18D.

It is to be noted that, although the three settings of large amount, standard amount, and small amount are used for pulverized toner adhering amount in FIGS. 18A through 18D, the number of settings is not limited thereto. Alternatively, a greater number of settings may be used. Settings according to one embodiment is in Table 2 below.

TABLE 2

| PULVERIZED TONER ADHERING AMOUNT SETTING | RANGE OF PULVERIZED TONER ADHERING AMOUNT A | NUMBER OF REVOLUTIONS FOR TONER CONVEYANCE |
|---|---|---|
| SETTING a | A < A1 | $W_S1$ |
| SETTING b | A1 ≤ A < A2 | $W_S2$ |
| SETTING c | A2 ≤ A < A3 | $W_S3$ |
| SETTING d | A3 ≤ A < A4 | $W_S4$ |
| SETTING e | A4 ≤ A | $W_S5$ |

In table 2, according to the range of pulverized toner adhering amount A, five settings (setting a through setting e) are used for the pulverized toner adhering amount. The setting a represents the pulverized toner adhering amount in the range smaller than A1, the setting b represents that in the range of A1≤A<A2, the setting c represents that in the range of A2≤A<A3, the setting d represents that in the range of A3≤A<A4, and the setting e represents the pulverized toner adhering amount A equal to or greater than A4 (A1<A2<A3<A4). The motor speed for transport of toner is set at $W_S$1 corresponding to the setting a, $W_S$2 corresponding to the setting b, $W_S$3 corresponding to the setting c, $W_S$4 corresponding to the setting, d, and $W_S$5 corresponding to the setting e.

Figure 19:
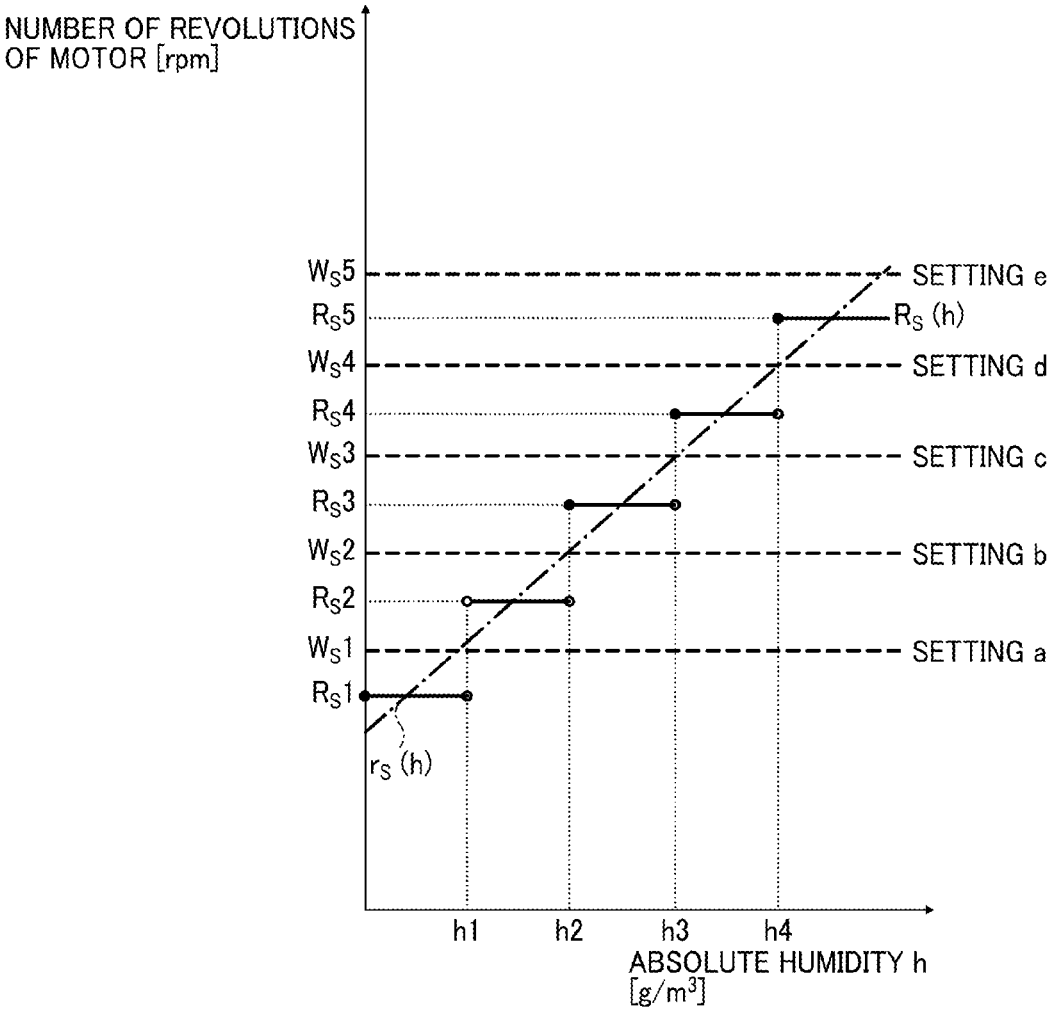
FIG. 19 is a graph for understanding of the motor speed in relation to the absolute humidity and an adhering amount of pulverized toner according to another embodiment.

As described above in the second embodiment, in practice, the motor speed for lubrication is not varied continuously as indicated by broken lines $r_{FC}(h)$ in FIG. 16A or $r_S(h)$ in FIG. 19 but varied stepwise as indicated by the solid lines $R_{FC}(h)$ in FIG. 16 A or $R_S(h)$ in FIG. 19 corresponding to the rise in the absolute humidity h.

As shown in FIG. 16A, in the case of polymerization toner, the revolution number $R_{FC}(h)$ for lubrication is set at $R_{FC}$1, $R_{FC}$2, $R_{FC}$3, $R_{FC}$4, and $R_{FC}$5 respectively for the five ranges of absolute humidity in the order mentioned above ($R_S$1<$R_{FC}$2<$R_{FC}$3<$R_{FC}$4<$R_{FC}$5). When polymerization toner is used, the relation $R_{FC}(h) > W_{FC}$ is constantly established relative to the absolute humidity h (see FIG. 16A), since the revolution number $W_{FC}$ for reliable transport of waste toner is smaller than $R_{FC}$1. Thus, the motor speed is set at $R_{FC}(h)$.

As shown in FIG. 19, in the case of pulverized toner, the revolution number $R_S(h)$ for lubrication is set at $R_S$1, $R_S$2, $R_S$3, $R_S$4, and $R_S$5 respectively for the five ranges of absolute humidity in the order mentioned above.

When the five settings of pulverized toner adhering amount in table 2 are used, the motor speed for transport of toner is as indicated by broken graphs in FIG. 19. That is, the revolution numbers $W_S$1, $W_S$2, $W_S$3, $W_S$4, and $W_S$5 are applied to the settings a, b, c, d, and e, respectively ($W_S$5>$R_S$5>$W_S$4>$R_S$4>$W_S$3>$R_S$3>$W_S$2>$R_S$2>$W_S$1>$R_S$1). It is to be noted that the range of pulverized toner adhering amount is not limited thereto and is divided differently in another embodiment.

In FIG. 19, when the pulverized toner adhering amount is at the setting a and the absolute humidity h is smaller than h1($h$<h1), $R_S(h)$<$W_S$1. When the absolute humidity h is greater than h1 (at any of ranges of h1≤h≤h2, h2<h<h3, h3<h<h4, and h4<h), the revolution number $R_S(h)$>$W_S$1. Accordingly, the motor revolution number is set at $W_S$1 when the absolute humidity h is smaller than h1. When the absolute humidity h is equal to or greater than h1 (at any of ranges of h1≤h<2, h2≤h<h3, h3≤h<h4, and h4≤h), the motor revolution number R(h) is set at $R_S(h)$.

In FIG. 19, when the pulverized toner adhering amount is at the setting b and the absolute humidity h is smaller than h2, ($h<h1$ and $h1 \leq h<h2$), $R_S(h)<W_S2$. When the absolute humidity h is equal to or greater than h2 (at any of ranges of $h2 \leq h<h3$, $h3 \leq h<h4$, and $h4 \leq h$), the revolution number $R_S(h)>W_S2$. Accordingly, the motor revolution number is set at $W_S2$ when the absolute humidity h is not greater than h2. When the absolute humidity h is equal to or greater than h2 (at any of ranges of $h2 \leq h<h3$, $h3 \leq h<h4$, and $h4 \leq h$), the motor revolution number R(h) is set at $R_S(h)$.

In FIG. 19, when the pulverized toner adhering amount is at the setting c and the absolute humidity h is smaller than h3, ($h<h1$, $h1 \leq h<h2$, and $h2 \leq h<h3$), $R_S(h)<W_S3$. When the absolute humidity h is equal to or greater than h3 ($h3 \leq h<h4$ and $h4 \leq h$), the revolution number $R_S(h)>W_S3$. Accordingly, the motor revolution number is set at $W_S3$ when the absolute humidity h is not greater than h3. When the absolute humidity h is equal to or greater than h3 ($h3<h<h4$ and $h4 \leq h$), the motor revolution number R(h) is set at $R_S(h)$.

In FIG. 19, when the pulverized toner adhering amount is at the setting d and the absolute humidity h is smaller than h4, ($h<h1$, $h1 \leq h \leq h2$, $h2 \leq h<h3$, and $h3 \leq h<h4$), $R_S(h)<W_S4$. When the absolute humidity h is equal to or greater than h4 ($h4 \leq h$), the revolution number $R_S(h)>W_S4$. Accordingly, the motor revolution number is set at $W_S4$ when the absolute humidity h is not greater than h4. When the absolute humidity h is equal to or greater than h4 ($h4 \leq h$), the motor revolution number R(h) is set at $R_S(h)$.

In FIG. 19, when the pulverized toner adhering amount is at the setting e, the relation $R_S(h)<W_S5$ is constantly true in any range of absolute humidity. Accordingly, the motor revolution number R(h) is set at $W_S5$.

The correlation between the absolute humidity range and the motor speed for lubrication for each toner type, an example of which is shown in table 1, is prestored in data storage device inside the image forming apparatus 1. Similarly, the correlation between pulverized toner adhering amount and the motor speed for transport of toner for each toner type, an example of which is shown in table 2, is prestored in data storage device inside the image forming apparatus 1.

Descriptions are given below of control flow of the motor revolution number R(h).

Figure 20:
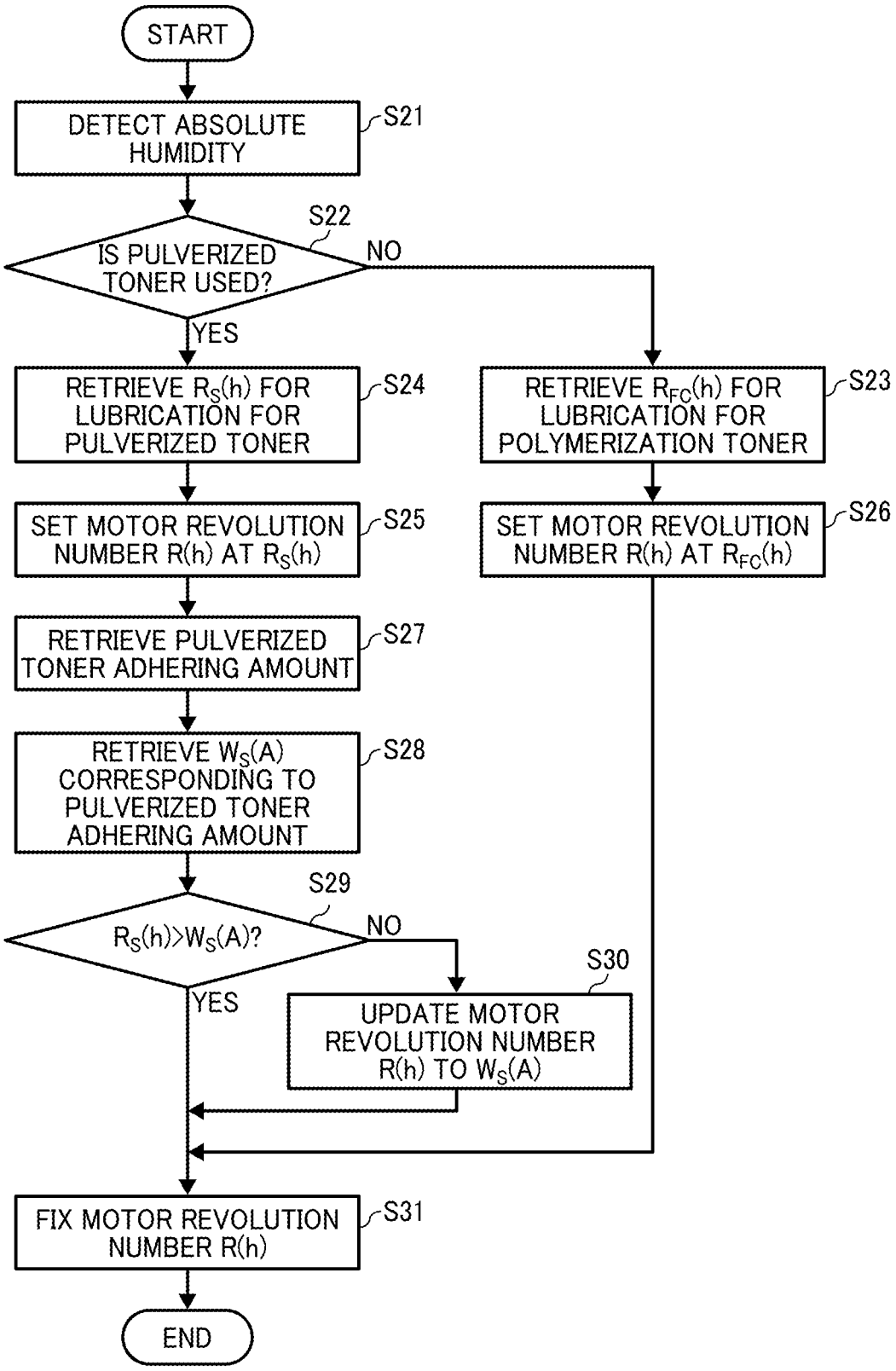
FIG. 20 is a flowchart of a sequence of processes to determine the motor speed, according to another embodiment.

FIG. 20 is a flowchart of a sequence of processes to determine the motor revolution number R(h).

At S21, the temperature and humidity sensor 203 of the image forming apparatus 1 detects the absolute humidity in the environment in which the apparatus is used.

At S22, the controller 800 identifies toner type in that image forming unit 10. In particular, whether or not pulverized toner is used is judged. When pulverized toner is used (Yes at S22), the process proceeds to S24. When polymerization toner is used, the process proceeds to S23.

At S23, from the correlation prestored in the data storage device, the revolution number $R_{FC}(h)$ for lubrication for polymerization toner, corresponding to the absolute humidity detected at S21, is retrieved. At S26, the motor revolution number R(h) is set at $R_{FC}(h)$ and confirmed at S31.

At S24, from the correlation prestored in the data storage device, the revolution number $R_S(h)$ for lubrication for pulverized toner, corresponding to the absolute humidity detected at S21, is retrieved. At S25, the motor revolution number R(h) is set at $R_S(h)$.

At S27, the pulverized toner adhering amount set by the controller 800, is retrieved. At S28, from the correlation prestored in the data storage device, the revolution number $W_S(A)$ for transport of toner for pulverized toner, corresponding to the pulverized toner adhering amount obtained at S27 is retrieved.

At S29, the value of $R_S(h)$, to which the motor revolution number R(h) is set at S25, is compared with the value of $W_S(A)$ retrieved at S28. When $R(h)>W_S(A)$, the possibility of clogging with waste toner is low, and at S31, R(h) is fixed at $R_S(h)$. By contrast, when $R(h) \leq W_S(A)$, clogging with waste toner is possible with R(h) fixed at $R_S(h)$ at S25. Accordingly, at S30, R(h) is updated to $W_S(A)$ and fixed at S31.

The process from S22 through S31 is performed for each of the multiple cleaning devices 40.

Typically, the motor revolution number ($R_{FC}1$, $R_{FC}2$, $R_{FC}3$, $R_{FC}4$, and $R_{FC}5$) for the cases of polymerization toner and the motor revolution number ($R_S1$, $R_S2$, $R_S3$, $R_S4$, and $R_S5$) for pulverized toner are in the relation of magnitude of $R_{FC}1>R_S1$, $R_{FC}2>R_S2$, $R_{FC}3>R_S3$, $R_{FC}4>R_S4$, and $R_{FC}5>R_S5$. When the difference between $R_{FC}n$ and $R_Sn$ (n=1 to 5) is small and ignorable in practice, $R_Sn$ for each cleaning device 40 is equal to $R_{FC}n$ in one embodiment. This setting is advantageous in simplifying the process to determine the motor speed since an identical motor speed is applied to all of the cleaning devices 40 of the image forming units 10 employing polymerization toner or pulverized toner when the apparatus is used in an environment in which the absolute humidity is greater than hp (shown in FIGS. 15A and 15B).

In the present embodiment, lubricant applied to the photoconductor 11 is scraped by the application roller 51 from the solid lubricant 50 produced by mixing zinc stearate, boron nitride, and alumina and compressing the mixture. Use of zinc stearate as fatty acid metallic salt added to lubricant is advantageous in enhancing the capability of lubricant to suppress degradation with time of image bearers, thereby inhibiting poor cleaning. Use of boron nitride as inorganic lubricant added to lubricant is advantageous in enhancing the capability of lubricant to suppress degradation with time of the cleaning blade 43 and the charging roller 22, thereby inhibiting poor cleaning.

As mentioned in the first embodiment, if the rotation speed of the conveying screw 16 is increased constantly aiming at improving the capability of the conveying screw 16 to transport waste toner, it is possible that the operational life of the conveying screw 16 is shortened due to excessive rotation thereof. Additionally, as in the present embodiment in which the conveying screw 16 and the application roller 51 are driven by a common driving source (i.e., the driving motor 51M), the rotation speed of the application roller 51 increases as the rotation speed of the conveying screw 16 increases. Accordingly, it is possible that the life of the solid lubricant 50 is shortened, or the charging roller 22 is stained due to excessive lubrication of the photoconductor 11, thus shortening the operational life of the charging roller 22.

Therefore, in one embodiment, increasing the rotation speed of the conveying screw 16 is limited to cases where the amount of toner removed from the photoconductor 11 by the cleaning device 40 is relatively large, such as when the image area ratio is large or toner adhesion amount to the photoconductor 11 is large.

Additionally, similar to the first embodiment, the image forming apparatus 1 according to the present embodiment can have a capability of widening the sheet interval area on the photoconductor 11 depending on toner type used in that image forming unit 10 during continuous image formation. It is preferred this operation be limited to cases where the amount of toner input to the cleaning device 40 is relatively large, such as when the image area ratio is large or toner adhesion amount to the photoconductor 11 is large.

It is to be noted that

The various aspects of the present specification can attain specific effects as follows.

Aspect A: Aspect A concerns an image forming apparatus that includes multiple image forming units each of which includes an image bearer; a toner image forming device to form a toner image on the image bearer; a transfer device to transfer the toner image from the image bearer onto a transfer medium; a cleaning device to remove toner from a surface of the image bearer from which the toner image is transferred; a hollow member (i.e., conveyance channel or waste-toner tube) through which toner removed by the cleaning device is transported; a toner conveying member to transport toner by rotation, disposed inside the tubular member. Toner type (i.e., a second toner) used in at least one of the multiple image forming units is different in flow properties from the toner type (i.e., a first toner) used in the rest of the multiple image forming units, and a rotation speed of the toner conveying member is variable for each of the multiple image forming units according to the toner type used therein. The hollow member through which waste toner flows is not limited to those cylindrical tubes and pipes but may be semicylindrical or rectangular in cross section.

In aspect A, according to toner type, in other words, the flow properties of toner, the toner transport capability of the toner conveying member is adjustable by increasing or reducing the rotation speed of the toner conveying member from a predetermined reference speed for each image forming unit. Accordingly, when the toner of poorer flow properties is used, the rotation speed of the toner conveying member is increased, thereby enhancing the toner transport capability of the toner conveying member. Therefore, clogging of the conveyance channel with toner is inhibited. When the toner of better flow properties is used, the rotation speed of the toner conveying member is reduced, thereby reducing the toner transport capability of the toner conveying member. Therefore, the load on the toner conveying member is reduced, thereby elongating the of the toner conveying member. Accordingly, even in configurations using different types of toners different in flow properties, clogging with toner and wear of the toner conveying member are inhibited while achieving commonality of components of the image forming units.

Aspect B: In aspect A, the rotation speed of the toner conveying member is increased when the amount of toner removed by the cleaning device is greater than the predetermined amount. With this aspect, as described above, the operational life of the toner conveying member is elongated since the rotation speed of the toner conveying member is increased only when high toner transport capability is necessary.

Aspect C: In aspect B, the rotation speed of the toner conveying member is increased when the image area ratio of the toner image on the image bearer is equal to or greater than a predetermined area. With this aspect, as described above, clogging with toner is inhibited while elongating the operational life of the toner conveying member.

Aspect D: In aspect B or C, the rotation speed of the toner conveying member is increased when the toner adhesion amount setting of the toner image on the image bearer is equal to or greater than a predetermined amount. With this aspect, as described above, clogging with toner is inhibited while elongating the operational life of the toner conveying member.

Aspect E: In any of aspects A, B, C, and D, a sheet interval area on the image bearer is widened according to the toner type used in the image forming unit during continuous image formation in which images are successively formed on multiple number of sheets of recording media. With this aspect, overflow of toner and clogging with toner are inhibited as described above.

Aspect F: In aspect E, when the amount of toner removed by the cleaning device is greater than the predetermined amount, the sheet interval area is widened according to the toner type used in the image forming unit. With this aspect, as described above, overflow of toner and clogging with toner are inhibited while reducing degradation in productivity.

Aspect G: In aspect F, the sheet interval area is widened according to the toner type used in the image forming unit when the image area ratio of the toner image on the image bearer is greater than the predetermined area. With this aspect, as described above, overflow of toner and clogging with toner are inhibited while reducing degradation in productivity.

Aspect H: In aspect F or G, the sheet interval area is widened according to the toner type used in the image forming unit when the toner adhesion amount setting of the toner image on the image bearer is greater than the predetermined amount. With this aspect, as described above, overflow of toner and clogging with toner are inhibited while reducing degradation in productivity.

Aspect I: In any of aspects A through D, the image forming apparatus further includes a downstream hollow member (i.e., a downstream conveyance channel) positioned downstream from the waste-toner channel, and a downstream toner conveying member to transport toner by rotation, the downstream toner conveying member disposed inside the downstream hollow member; and the rotation speed of the downstream toner conveying member is increased according to the toner type in the image forming unit. With this aspect, clogging of the downstream conveyance channel with toner is inhibited as described above. The downstream hollow member through which waste toner flows is not limited to those cylindrical tubes and pipes but may be semicylindrical or rectangular in cross section.

Aspect J: In aspect I, the rotation speed of the downstream toner conveying member is increased when the amount of toner removed by the cleaning device is greater than the predetermined amount. With this aspect, as described above, clogging of the downstream conveyance channel with toner is inhibited while elongating the operational life of the downstream toner conveying member.

Aspect K: In aspect J, the rotation speed of the downstream toner conveying member is increased when the image area ratio of the toner image on the image bearer is equal to or greater than a predetermined area. With this aspect, as described above, clogging of the downstream conveyance channel with toner is inhibited while elongating the operational life of the downstream toner conveying member.

Aspect L: In aspect J or K, the rotation speed of the downstream toner conveying member is increased when the toner adhesion amount setting of the toner image on the image bearer is equal to or greater than a predetermined amount. With this aspect, as described above, clogging of the downstream conveyance channel with toner is inhibited while elongating the operational life of the downstream toner conveying member.

Aspect M: In any of aspects A through L, the toner type includes polymerization toner and pulverized toner. With this aspect, as described above, toner type is selectable from polymerization toner and pulverized toner for each image forming unit depending on an intended effect such as image quality improvement or cleaning performance improvement, thus attaining desirable image formation.

Aspect N: In any of aspects A through L, the toner type includes colored toner and transparent toner. With this aspect, transparent toner is used as an overcoat to protect colored toner images or improve the gloss level of images as described above.

Aspect O: In any of aspects A through N, the cleaning device includes a lubricant applicator to apply lubricant onto the surface of the image bearer, and each of the multiple image forming units further includes a driving source to drive both of the lubricant applicator and the toner conveying member, out of the multiple image forming units, the controller sets a rotation speed of the driving source of the cleaning device of the image forming unit using the second toner having poorer flow properties to an increased value from a rotation speed of the driving source of the cleaning device of the image forming unit using the first toner.

In the image forming unit using the toner of poorer flow properties than the toner used in the rest of the image forming units, there is a range of absolute humidity in which a minimum required rotation speed of the driving source (such as the driving motor) for reliable transport of waste toner by the toner conveying member (such as the conveying screw 16) is greater than the minimum required rotation speed of the driving source for desirable lubrication of the image bearer by the application roller 51. When the rotation speed of the driving source of the cleaning device in the rest of the image forming units is set at the rotation speed for desirable lubrication of the image bearer, increasing the rotation speed of the driving source of the cleaning device of the image forming unit using the toner of poorer flow properties than that in the rest of the image forming units is advantageous in transporting waste toner reliably in all image forming units even if the absolute humidity is in the above-described range.

Aspect P: In aspect O, the rotation speed of the driving source is increased when the absolute humidity is in a first range in which the rotation speed for lubrication, required for protecting the image bearer with lubricant, is lower than the rotation speed required for reliable transport of waste toner by the toner conveying member.

In the setting in which the rotation speed for lubrication is identical in all the image forming units and the rotation speed of the driving source of the cleaning device is set at the rotation speed for lubrication in the rest of the image forming units, if the rotation speed of the driving source in the image forming unit using the toner of poorer flow properties is identical to that in the rest of the image forming units when the absolute humidity is in the first range, it is possible that waste toner is not properly transported in the image forming unit using the toner of poorer flow properties. In this case, waste toner can be transported properly in the entire image forming units by increasing the rotation speed of the driving source from that in the rest of the image forming units.

Aspect Q: In aspect P, when the absolute humidity is in the first range, the rotation speed of the driving source in the image forming unit using the toner of poorer flow properties is set at the for transport of toner.

When the absolute humidity is in the first range, there arises an inconvenience if the rotation speed of the driving source of the cleaning device in the image forming unit using the toner of poorer flow properties is identical to that in the rest of the image forming units. Specifically, the rotation speed of the driving source in the image forming unit using the toner of poorer flow properties falls below the rotation speed required for reliable transport of toner by the toner conveying member such as the conveying screw 16. In this case, in the image forming unit using the toner of poorer flow properties, the cleaning device fails to reliably transport waste toner. In view of the foregoing, when the absolute humidity is in the first range, the rotation speed of the driving source is set at the rotation speed for transport of toner in the image forming unit using the toner of poorer flow properties so that waste toner can be transported properly in all the image forming units.

Aspect R: In aspect Q, when the absolute humidity is in a second range in which the rotation speed for lubrication is higher than the rotation speed for transport of toner in the image forming unit using the second toner, the controller sets the rotation speed of the driving source of the cleaning device of the image forming unit using the second toner to the rotation speed for transport of toner.

When the absolute humidity is in the second range, the rotation speed for lubrication is constantly greater than the rotation speed for transport of toner also in the clearing device of the image forming unit using the toner of poorer flow properties. Accordingly, waste toner can be transported properly by the toner conveying member when the rotation speed of the driving source of the cleaning device is set at the rotation speed for lubrication in the image forming unit using the toner of poorer flow properties.

Aspect S: In aspect R, when the absolute humidity is in the second range, the driving sources of the respective image forming units are set to rotate at an identical rotation speed.

When the absolute humidity is in the second range, in the cleaning device of any one of the multiple image forming units, the rotation speed of the driving source for desirable lubrication of the image bearer is constantly greater than the rotation speed for reliable transport of waste toner. In a case where the difference in toner type does not cause a substantial difference in the rotation speed for desirable lubrication among the image forming units, use of an identical rotation speed of the driving source in the multiple image forming units is advantageous in simplifying the process to determine the rotation speed while maintaining reliable transport of waste toner.

Aspect T: In any one of aspects O through S, the lubricant supplied by the application roller includes fatty acid metallic salt and inorganic lubricant.

Use of zinc stearate as fatty acid metallic salt added to lubricant is advantageous in enhancing the capability of lubricant to suppress degradation with time of the image bearer, thereby inhibiting poor cleaning. Use of boron nitride as inorganic lubricant added to lubricant is advantageous in enhancing the capability of lubricant to suppress degradation with time of the cleaning blade 43 and the charging roller 22, thereby inhibiting poor cleaning.

Aspect U: In aspect T, the fatty acid metallic salt is zinc stearate and the inorganic lubricant is boron nitride.

Use of zinc stearate as fatty acid metallic salt added to lubricant is advantageous in enhancing the capability of lubricant to suppress degradation with time of the image bearer, thereby inhibiting poor cleaning in particular. Additionally, use of boron nitride as inorganic lubricant added to lubricant is advantageous in enhancing the capability of lubricant to suppress degradation with time of the cleaning blade 43 and the charging roller 22, thereby inhibiting poor cleaning in particular.

Aspect V: Aspect V concerns an image forming apparatus that includes multiple image forming units each of which includes an image bearer; a toner image forming device to form a toner image on the image bearer; a transfer device to transfer the toner image from the image bearer onto a transfer medium; a cleaning device to remove toner from a surface of the image bearer from which the toner image is transferred; a tubular member to define a waste-toner channel through which toner removed by the cleaning device is transported; a toner conveying member to transport toner by rotation, disposed inside the tubular member. In this configuration, the cleaning device includes a lubricant applicator to apply lubricant onto the surface of the image bearer, and each of the multiple image forming units further includes a driving source to drive both of the lubricant applicator and the toner conveying member. Multiple toner types are usable in the image forming apparatus, and at least one of the multiple image forming units uses a second toner having poorer flow properties than a first toner used in rest of the image forming units. The rotation speed of the driving source is variable individually in the multiple image forming units. The rotation speed of the driving source of the cleaning device of the image forming unit using the second toner having poorer flow properties is set to an increased value from a rotation speed of the driving source of the cleaning device of the image forming unit using the first toner.

Commonality of components among the multiple image forming units is achieved when the rotation speed of the driving source is variable individually in the multiple image forming units including the image forming unit using the toner of poorer flow properties. Additionally, in the image forming unit using the toner of poorer flow properties, there is a range of absolute humidity in which a minimum required rotation speed of the driving source (such as the driving motor) for reliable transport of waste toner by the toner conveying member (such as the conveying screw 16) is greater than the minimum required rotation speed of the driving source for desirable lubrication of the image bearer by the application roller 51. When the rotation speed of the driving source of the cleaning device in the rest of the image forming units is set at the rotation speed for desirable lubrication of the image bearer, increasing the rotation speed of the driving source of the cleaning device of the image forming unit using the toner of poorer flow properties than that in the rest of the image forming units is advantageous in transporting waste toner reliably in all the image forming units even if the absolute humidity is in the above-described range.

Aspect W: In any one of aspects P through U, the controller includes a computing unit to calculate the rotation speed for transport of toner. The computing unit calculates the rotation speed for transport of toner in the image forming unit using the toner of poorer flow properties, according setting of toner adhesion amount on the surface of the image bearer calculated according to image data input to the image forming apparatus.

The above-described rotation speed for transport of toner depends on the toner adhesion amount on the photoconductor 11. The rotation speed for transport of toner is higher when the toner adhesion amount is greater, and the rotation speed for transport of toner is lower when the toner adhesion amount is smaller. The rotation speed, however, is set to an excessively high value if the rotation speed for transport of toner is constantly calculated to respond to the case where the toner adhesion amount is greater. In the configuration in which the conveying screw 16 and the application roller 51 are rotated by a common driving source, the consumption of lubricant increases as the rotation speed of the driving source increases. Accordingly, compared with the image forming unit 10 using toner of different type, in the cleaning device 40 of the image forming unit 10 using pulverized toner, the consumption of lubricant is greater and the useful life of lubricant is significantly shortened. If replacement frequency of the cleaning device 40 in the image forming unit 10 using pulverized toner is high, it is inconvenient for users. In view of the foregoing, excessive increases in consumption of lubricant are inhibited by calculating the toner adhesion amount in the image forming unit using the toner of poorer flow properties based on image data and calculating the rotation speed for transport of toner based on the toner adhesion amount.

It is to be noted that, the steps in the above-described flowcharts may be executed in an order different from that in the flowchart. Further, elements and/or features of different example embodiments may be combined with each other and/or substituted for each other within the scope of this disclosure and appended claims.

Still further, any one of the above-described and other example features of the present specification may be embodied in the form of an apparatus, method, system, computer program and computer program product. For example, the aforementioned methods may be embodied in the form of a system or device, including, but not limited to, any of the structure for performing the methodology illustrated in the drawings. Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

multiple image forming units each of which includes:

an image bearer;

a toner image forming device to form a toner image on the image bearer;

a transfer device to transfer the toner image from the image bearer onto a transfer medium;

a cleaning device to remove toner from a surface of the image bearer from which the toner image is transferred;

a waste-toner tube through which toner removed by the cleaning device is transported;

a toner conveyor to transport toner by rotation, the toner conveyor disposed inside the waste-toner tube; and a controller to change a rotation speed of the toner conveyor for each of the multiple image forming units according to toner type including a first toner and a second toner having poorer flow properties than the first toner, wherein at least one of the multiple image forming units uses the second toner and the remaining image forming units use the first toner.

2. The image forming apparatus according to claim 1, wherein the controller sets the rotation speed of the toner conveyor to an increased speed when a toner-related variable contributing to an increase in amount of toner removed by the cleaning device exceeds a threshold level.

3. The image forming apparatus according to claim 2, wherein the toner-related variable comprises an image area ratio of the toner image on the image bearer.

4. The image forming apparatus according to claim 2, wherein the toner-related variable comprises a setting of toner adhesion amount to the image bearer determined by the controller.

5. The image forming apparatus according to claim 1, wherein the controller widens a sheet interval area on the image bearer according to the toner type used in the image forming unit during continuous image formation in which images are successively formed on multiple number of sheets of recording media.

6. The image forming apparatus according to claim 5, wherein, when a toner-related variable contributing to an increase in amount of toner removed by the cleaning device exceeds a threshold level, the controller widens the sheet interval area according to the toner type used in the image forming unit.

7. The image forming apparatus according to claim 6, wherein the toner-related variable comprises an image area ratio of the toner image on the image bearer.

8. The image forming apparatus according to claim 6, wherein the toner-related variable comprises a setting of toner adhesion amount to the image bearer determined by the controller.

9. The image forming apparatus according to claim 1, further comprising:

a downstream conveyance tube positioned downstream from the waste-toner tube; and a downstream toner conveyor to transport toner by rotation, the downstream toner conveyor disposed inside the downstream conveyance tube, wherein the controller sets a rotation speed of the downstream toner conveyor to an increased speed according to the toner type for each of the multiple image forming units.

10. The image forming apparatus according to claim 9, wherein the controller determines the rotation speed of the downstream toner conveyor according to a toner-related variable that contributes to an increase in amount of toner removed by the cleaning device.

11. The image forming apparatus according to claim 10, wherein the toner-related variable comprises an image area ratio of the toner image on the image bearer.

12. The image forming apparatus according to claim 10, wherein the toner-related variable comprises a setting of toner adhesion amount to the image bearer determined by the controller.

13. The image forming apparatus according to claim 1, wherein the toner type comprises polymerization toner and pulverized toner.

14. The image forming apparatus according to claim 1, wherein the toner type comprises colored toner and transparent toner.

15. The image forming apparatus according to claim 1, wherein the cleaning device comprises a lubricant applicator to apply lubricant onto the surface of the image bearer, each of the multiple image forming units further comprises a driving source to drive both of the lubricant applicator and the toner conveyor, and the controller sets a speed of the driving source of the cleaning device of the at least one of the multiple image forming units using the second toner to an increased speed from a speed of the driving source of the cleaning device of the image forming unit using the first toner.

16. The image forming apparatus according to claim 15, further comprising a humidity detector to detect absolute humidity in an environment in which the image forming apparatus is installed, wherein, when a speed for lubrication refers to a speed of the driving source to maintain lubrication by the lubricant applicator and a speed for transport of toner refers to a speed of the driving source to maintain transport of toner by the toner conveyor, the controller sets the speed of the driving source of the cleaning device of the at least one of the multiple image forming units using the second toner to the increased speed when the absolute humidity detected by the humidity detector is in a first range in which the speed for lubrication is lower than the speed for transport of toner in the at least one of the multiple image forming units using the second toner.

17. The image forming apparatus according to claim 16, wherein, when the absolute humidity detected by the humidity detector is in the first range, the controller sets the speed of the driving source of the cleaning device of the at least one of the multiple image forming units using the second toner to the speed for transport of toner.

18. An image forming apparatus comprising:

multiple image forming units each of which includes:

an image bearer;

a toner image forming device to form a toner image on the image bearer;

a transfer device to transfer the toner image from the image bearer onto a transfer medium;

a cleaning device to remove toner from a surface of the image bearer from which the toner image is transferred, the cleaning device including a lubricant application roller to apply lubricant onto the surface of the image bearer and a driving source to drive both of the lubricant applicator and the toner conveyor;

a waste-toner tube through which toner removed by the cleaning device is transported; and a toner conveyor to transport toner by rotation, the toner conveyor disposed inside the waste-toner tube, wherein at least one of the multiple image forming units uses a second toner having poorer flow properties than a first toner used in the remaining image forming units, and the controller sets a speed of the driving source of the cleaning device of the at least one of the multiple image forming units using the second toner to an increased speed from a speed of the driving source of the cleaning device of the image forming unit using the first toner.

19. An image forming apparatus comprising:

multiple image forming units each of which includes:

an image bearer, a toner image forming device configured to form a toner image on the image bearer;

a transfer device configured to transfer the toner image from the image bearer onto a transfer medium, and a cleaning device configured to remove toner from a surface of the image bearer from which the toner image is transferred;

a first toner conveyor configured to transport a first toner at a first rotational speed; and a second toner conveyor configured to transport a second toner at a second rotational speed, different from the first rotational speed, the second toner having poorer flow properties than the first toner, wherein at least one of the multiple image forming units uses the second toner and the remaining image forming units use the first toner.

20. The image forming apparatus according to claim 19, wherein at least one of the first and second toner conveyors is a component of at least one of the multiple image forming units.

* * * * *